US010486010B1

(12) United States Patent
Leipheimer

(10) Patent No.: US 10,486,010 B1
(45) Date of Patent: Nov. 26, 2019

(54) WEIGHT RATIO ARRANGEMENT FOR A WEIGHT MACHINE

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 0 days.

(21) Appl. No.: 16/347,642

(22) PCT Filed: Nov. 9, 2017

(86) PCT No.: PCT/US2017/060845

§ 371 (c)(1),
(2) Date: May 6, 2019

(87) PCT Pub. No.: WO2018/089624

PCT Pub. Date: May 17, 2018

Related U.S. Application Data

(60) Provisional application No. 62/421,643, filed on Nov. 14, 2016.

(51) Int. Cl.
*A63B 21/00* (2006.01)
*A63B 21/062* (2006.01)
(Continued)

(52) U.S. Cl.
CPC ..... *A63B 21/156* (2013.01); *A63B 21/0628* (2015.10); *A63B 21/078* (2013.01);
(Continued)

(58) Field of Classification Search
CPC ..... A63B 21/156; A63B 23/03525; A63B 23/03558; A63B 21/4043; A63B 21/078; A63B 21/0628; A63B 2225/09
See application file for complete search history.

(56) References Cited

U.S. PATENT DOCUMENTS 3,438,627 A * 4/1969 La Lanne ..... A63B 21/06 482/103
4,154,441 A * 5/1979 Gajda ..... A63B 21/0626 482/102

(Continued)

FOREIGN PATENT DOCUMENTS

WO 2005002678 A2 1/2005

*Primary Examiner* — Garrett K Atkinson
(74) *Attorney, Agent, or Firm* — The Webb Law Firm

(57) ABSTRACT

An exercise machine including a support frame, a weight stack slidably connected to the support frame, a weight ratio pulley arrangement engaged with the support frame, the weight stack, and an attachment extending from the support frame, the weight ratio arrangement including an exercise cable and at least two movable pulley blocks, a weight stack pulley arrangement engaged with the support frame, the weight stack, and one of the movable pulley blocks of the weight ratio pulley arrangement, the weight stack pulley arrangement including a weight stack cable, the weight stack cable being in operative connection with one of the movable pulley blocks of the weight ratio pulley arrangement, and a locking mechanism movable between a locked position in which only one movable pulley block is movable and an unlocked position in which the two movable pulley blocks are movable.

20 Claims, 27 Drawing Sheets

(51) Int. Cl.
*A63B 21/078* (2006.01)
*A63B 23/035* (2006.01)

(52) U.S. Cl.
CPC .... *A63B 21/4043* (2015.10); *A63B 23/03525* (2013.01); *A63B 23/03558* (2013.01); *A63B 2225/09* (2013.01)

(56) References Cited

U.S. PATENT DOCUMENTS 4,402,504 A * 9/1983 Christian ..... A63B 21/06 482/103
4,603,855 A * 8/1986 Sebelle ..... A63B 21/06 482/103
4,640,268 A * 2/1987 Roberts ..... A63B 21/06 482/139
5,102,122 A * 4/1992 Piane, Jr. ..... A63B 21/156 482/103
5,725,459 A * 3/1998 Rexach ..... A63B 21/0628 482/102
6,165,110 A * 12/2000 Gajda ..... A63B 21/06 482/102
6,217,493 B1 * 4/2001 Spletzer ..... A63B 21/0605 482/103
6,338,701 B1 1/2002 Webber
6,394,935 B1 * 5/2002 Lake ..... A63B 21/154 482/93
6,685,600 B1 * 2/2004 Ullman ..... A63B 21/156 482/100
6,770,015 B2 * 8/2004 Simonson ..... A63B 21/154 482/101
7,331,912 B2 2/2008 Keiser et al.
7,335,141 B2 * 2/2008 Piane, Jr. ..... A63B 21/055 482/101
7,503,882 B2 * 3/2009 Sechrest ..... A63B 21/152 482/103
7,654,942 B1 2/2010 Batca
7,758,478 B2 7/2010 Golesh et al.
8,246,524 B2 * 8/2012 Castillo ..... A63B 21/023 482/101
8,968,164 B2 * 3/2015 Giannelli ..... A63B 21/154 482/102
9,050,496 B2 * 6/2015 Towley, III ..... A63B 21/0628
9,821,188 B2 * 11/2017 Dwork ..... A63B 21/16
2001/0034290 A1 * 10/2001 Tolles ..... A63B 21/152 482/99
2002/0091043 A1 * 7/2002 Rexach ..... A63B 21/156 482/98
2004/0018920 A1 * 1/2004 Simonson ..... A63B 21/154 482/99
2007/0042878 A1 * 2/2007 Lundquist ..... A63B 21/06 482/99
2008/0242520 A1 * 10/2008 Hubbard ..... A63B 21/063 482/98
2008/0287270 A1 * 11/2008 Carter ..... A63B 21/154 482/99
2008/0300116 A1 * 12/2008 Eder ..... A63B 21/156 482/100
2011/0230315 A1 * 9/2011 Castillo ..... A63B 21/023 482/94
2013/0065737 A1 * 3/2013 Habing ..... A63B 21/156 482/102
2013/0303346 A1 * 11/2013 Barker ..... A63B 21/018 482/129
2013/0337982 A1 * 12/2013 Williams ..... A63B 21/02 482/122

* cited by examiner

WEIGHT RATIO ARRANGEMENT FOR A WEIGHT MACHINE

CROSS-REFERENCE TO RELATED APPLICATIONS

This application is the United States national phase of International Application No. PCT/US2017/060845 filed Nov. 9, 2017, and claims priority to U.S. Provisional Patent Application No. 62/421,643 filed Nov. 14, 2016, the disclosures of which are hereby incorporated by reference in their entirety.

BACKGROUND OF THE INVENTION

Field of the Invention

This disclosure relates generally to exercise or weight machines and, more particularly, to a weight ratio arrangement that allows a user to vary a mechanical advantage provided by traditional pulley arrangements on the exercise or weight machines.

Description of Related Art

Various exercise machines for strength training and conditioning have been developed including machines that utilize a weight stack and pulley arrangement to provide resistance to an exercising motion by a user. A conventional exercise machine has a frame, a load or some type of arrangement for providing resistance mounted on the frame, and multiple exercise stations that are connected to the load. Typically, pulleys and cables are used to connect the load to the exercise stations. The pulleys and cables provide a mechanical advantage to a user using the exercise station. The mechanical advantage provided can be positive, negative, or neutral.

A conventional cable and pulley arrangement uses a first cable connected at a first end to the load or weight stack and at a second end to a first pulley. A second cable may be connected at a first end to a first exercise station. A second end of the second cable may engage a second pulley, then engage the first pulley, then a third pulley before finally being fixed to the frame. This pulley configuration allows the user to provide a force of 50% of the load or weight stack to lift the load or weight stack. The mechanical advantage in this pulley and cable arrangement is in a ratio of 2:1. The addition or subtraction of pulleys alters the mechanical advantage experienced by the user.

Many exercise machines are designed for use in areas that are smaller than a traditional gym, for example, a home or apartment. With these reduced areas, it has become increasingly important to conserve space by reducing the size of exercise machines. This reduced area arrangement for exercise machines is accomplished by providing multiple cable and pulley arrangements that are operable independent of one another. Conventional cable and pulley arrangements incorporate a fixed mechanical advantage that is predetermined by the number and position of the pulleys in the system.

Using these conventional cable and pulley arrangements, the user is limited to changing resistance levels in fixed increments determined by how much each weight of the weight stack weighs. For example, if the cable and pulley system allows for a 2:1 ratio and each weight plate in the weight stack weighs 20 pounds, the user can change the resistance only in 10 pound increments. For an exerciser to increase the resistance by less than a full 10 pounds, for example by 5 pounds, the user must add further weight to the stack, which are often in the form of a smaller weight to attach to the weight stack.

Other exercise machines have been developed that allow for a plurality of weight ratios. In particular, a cable and pulley arrangement including two floating pulleys that allow for an exercise machine to contain multiple exercise stations having varying mechanical advantage ratios have been developed. Devices using this type of arrangement, however, typically require the use of different exercise stations to vary the weight ratio. Due to the need to change exercise stations, the ability of the user to choose a varied weight ratio while exercising at the same station is not provided. A weight ratio device may affect the cable pull and weight ratio together. Some user exercises need short travel and a heavy load, while other user exercises need long travel and a light load. Therefore, having an effective conversion mechanism on the same exercise machine could reduce the amount of exercise machines needed to perform the various user exercises.

SUMMARY OF THE INVENTION

In view of the foregoing, a need exists for an exercise machine that provides varying weight ratios for the user while exercising at the same station.

According to an aspect of the disclosure, an exercise machine includes a support frame, a weight stack slidably connected to the support frame, a weight ratio pulley arrangement engaged with the support frame, the weight stack, and an attachment extending from the support frame, the weight ratio arrangement including an exercise cable having a first end and a second end, the first end being connected to the attachment and the second end being connected to a portion of the support frame, and at least two movable pulley blocks, each movable pulley block including at least one pulley, a weight stack pulley arrangement engaged with the support frame, the weight stack, and one of the movable pulley blocks of the weight ratio pulley arrangement, the weight stack pulley arrangement including a weight stack cable having a first and a second end, the first end connected to the weight stack and the second end connected to the support frame, wherein the weight stack cable is in operative connection with one of the movable pulley blocks of the weight ratio pulley arrangement, and a locking mechanism movable between a locked position in which only one movable pulley block is movable and an unlocked position in which the two movable pulley blocks are movable.

A first movable pulley block of the at least two movable pulley blocks may be operatively connected to the exercise cable and the weight stack cable. A second movable pulley block of the at least two movable pulley blocks may be operatively connected to only the exercise cable. The second movable pulley block may be prevented from moving when the lock mechanism is provided in the locked position. A first movable pulley block of the at least two movable pulley blocks may include two pulleys, and a second movable pulley block of the at least two movable pulley blocks may include one pulley. The locking mechanism may include a latching lever and a handle insertable into the latching lever to place the latching lever in a locked position. The latching lever may be rotatable between an unlocked position in which the latching lever is disengaged from one movable pulley block of the at least two movable pulley blocks, and a locked position in which the latching lever is engaged with the one movable pulley block of the at least two movable pulley blocks. At least one pulley may be positioned on the support frame adjacent the attachment, in which the at least one pulley directs the exercise cable in a downward direction. The at least one pulley may be movable in a vertical direction on the support frame. At least one guide rod may be attached to the support frame, in which the at least two movable pulley blocks may be configured to move in a vertical direction along the at least one guide rod. A stop member may be positioned between the at least two movable pulley blocks to prevent the at least two movable pulley blocks from contacting one another.

In another aspect of the disclosure, a cable and pulley arrangement for an exercise machine includes a weight ratio pulley arrangement engaged with the support frame, the weight stack, and an attachment extending from the support frame, the weight ratio arrangement including an exercise cable having a first end and a second end, the first end being connected to the attachment and the second end being connected to a portion of the support frame, and at least two movable pulley blocks, each movable pulley block including at least one pulley, a weight stack pulley arrangement engaged with the support frame, the weight stack, and one of the movable pulley blocks of the weight ratio pulley arrangement, the weight stack pulley arrangement including a weight stack cable having a first and a second end, the first end connected to the weight stack and the second end connected to the support frame, wherein the weight stack cable is in operative connection with one of the movable pulley blocks of the weight ratio pulley arrangement, and a locking mechanism movable between a locked position in which only one movable pulley block is movable and an unlocked position in which the two movable pulley blocks are movable.

In another aspect of the disclosure, a first movable pulley block of the at least two movable pulley blocks may be operatively connected to the exercise cable and the weight stack cable. A second movable pulley block of the at least two movable pulley blocks may be operatively connected to only the exercise cable. The second movable pulley block may be prevented from moving when the lock mechanism is provided in the locked position. A first movable pulley block of the at least two movable pulley blocks may include two pulleys, and a second movable pulley block of the at least two movable pulley blocks may include one pulley. The locking mechanism may include a latching lever and a handle insertable into the latching lever to place the latching lever in a locked position. The latching lever may be rotatable between an unlocked position in which the latching lever is disengaged from one movable pulley block of the at least two movable pulley blocks, and a locked position in which the latching lever is engaged with the one movable pulley block of the at least two movable pulley blocks. At least one guide rod may be attached to the support frame, in which the at least two movable pulley blocks may be configured to move in a vertical direction along the at least one guide rod. A stop member may be positioned between the at least two movable pulley blocks to prevent the at least two movable pulley blocks from contacting one another.

In another aspect of the disclosure, a method of operating an exercise machine, includes (a) setting a locking mechanism on a support frame of the exercise machine to either an unlocked or locked position; (b) pulling an exercise cable relative to a support frame of the exercise machine; and (c) with the locking mechanism in the unlocked position, upon pulling the exercise cable, pulling at least two movable pulley blocks that in turn pulls a weight stack operatively connected to one of the movable pulley blocks; or (d) with the locking mechanism in the locked position, upon pulling the exercise cable, pulling one movable pulley block that in turn pulls a weight stack operatively connected to the movable pulley block.

In another aspect of the disclosure, a first movable pulley block of the at least two movable pulley blocks may be operatively connected to the exercise cable and the weight stack cable, a second movable pulley block of the at least two movable pulley blocks may be operatively connected to only the exercise cable, and the second movable pulley block may be prevented from moving when the locking mechanism is provided in the locked position. The locking mechanism may include a handle that is configured to be pulled away from the locking mechanism to unlock the locking mechanism. The at least two movable pulley blocks may be configured to move along at least one guide rail.

The invention is further defined by the following clauses:

Clause 1: An exercise machine, comprising: a support frame; a weight stack slidably connected to the support frame; a weight ratio pulley arrangement engaged with the support frame, the weight stack, and an attachment extending from the support frame, the weight ratio arrangement comprising: an exercise cable having a first end and a second end, the first end being connected to the attachment and the second end being connected to a portion of the support frame; and at least two movable pulley blocks, each movable pulley block including at least one pulley, a weight stack pulley arrangement engaged with the support frame, the weight stack, and one of the movable pulley blocks of the weight ratio pulley arrangement, the weight stack pulley arrangement comprising a weight stack cable having a first and a second end, the first end connected to the weight stack and the second end connected to the support frame, wherein the weight stack cable is in operative connection with one of the movable pulley blocks of the weight ratio pulley arrangement; and a locking mechanism movable between a locked position in which only one movable pulley block is movable and an unlocked position in which the two movable pulley blocks are movable.

Clause 2: The exercise machine as claimed in Clause 1, wherein a first movable pulley block of the at least two movable pulley blocks is operatively connected to the exercise cable and the weight stack cable, wherein a second movable pulley block of the at least two movable pulley blocks is operatively connected to only the exercise cable, and wherein the second movable pulley block is prevented from moving when the locking mechanism is provided in the locked position.

Clause 3: The exercise machine as claimed in either of Clause 1 or 2, wherein a first movable pulley block of the at least two movable pulley blocks comprises two pulleys, and wherein a second movable pulley block of the at least two movable pulley blocks comprises one pulley.

Clause 4: The exercise machine as claimed in any of Clauses 1-3, wherein the locking mechanism comprises: a latching lever; and a handle insertable into the latching lever to place the latching lever in a locked position.

Clause 5: The exercise machine as claimed in Clause 4, wherein the latching lever is rotatable between an unlocked position in which the latching lever is disengaged from one movable pulley block of the at least two movable pulley blocks, and a locked position in which the latching lever is engaged with the one movable pulley block of the at least two movable pulley blocks.

Clause 6: The exercise machine as claimed in any of Clauses 1-5, further comprising at least one pulley positioned on the support frame adjacent the attachment, wherein the at least one pulley directs the exercise cable in a downward direction.

Clause 7: The exercise machine as claimed in Clause 6, wherein the at least one pulley is movable in a vertical direction on the support frame.

Clause 8: The exercise machine as claimed in any of Clauses 1-7, further comprising at least one guide rod attached to the support frame, wherein the at least two movable pulley blocks are configured to move in a vertical direction along the at least one guide rod.

Clause 9: The exercise machine as claimed in any of Clauses 1-8, further comprising a stop member positioned between the at least two movable pulley blocks to prevent the at least two movable pulley blocks from contacting one another.

Clause 10: A cable and pulley arrangement for an exercise machine, comprising: a weight ratio pulley arrangement engaged with the support frame, the weight stack, and an attachment extending from the support frame, the weight ratio arrangement comprising: an exercise cable having a first end and a second end, the first end being connected to the attachment and the second end being connected to a portion of the support frame; and at least two movable pulley blocks, each movable pulley block including at least one pulley, a weight stack pulley arrangement engaged with the support frame, the weight stack, and one of the movable pulley blocks of the weight ratio pulley arrangement, the weight stack pulley arrangement comprising a weight stack cable having a first and a second end, the first end connected to the weight stack and the second end connected to the support frame, wherein the weight stack cable is in operative connection with one of the movable pulley blocks of the weight ratio pulley arrangement; and a locking mechanism movable between a locked position in which only one movable pulley block is movable and an unlocked position in which the two movable pulley blocks are movable.

Clause 11: The cable and pulley arrangement for an exercise machine as claimed in Clause 10, wherein a first movable pulley block of the at least two movable pulley blocks is operatively connected to the exercise cable and the weight stack cable, wherein a second movable pulley block of the at least two movable pulley blocks is operatively connected to only the exercise cable, and wherein the second movable pulley block is prevented from moving when the lock mechanism is provided in the locked position.

Clause 12: The cable and pulley arrangement for an exercise machine as claimed in either Clause 10 or 11, wherein a first movable pulley block of the at least two movable pulley blocks comprises two pulleys, and wherein a second movable pulley block of the at least two movable pulley blocks comprises one pulley.

Clause 13: The cable and pulley arrangement for an exercise machine as claimed in any of Clauses 10-12, wherein the locking mechanism comprises: a latching lever; and a handle insertable into the latching lever to place the latching lever in a locked position.

Clause 14: The cable and pulley arrangement for an exercise machine as claimed in Clause 13, wherein the latching lever is rotatable between an unlocked position in which the latching lever is disengaged from one movable pulley block of the at least two movable pulley blocks, and a locked position in which the latching lever is engaged with the one movable pulley block of the at least two movable pulley blocks.

Clause 15: The cable and pulley arrangement for an exercise machine as claimed in any of Clause 10-14, further comprising at least one guide rod attached to a support frame, wherein the at least two movable pulley blocks are configured to move in a vertical direction along the at least one guide rod.

Clause 16: The cable and pulley arrangement for an exercise machine as claimed in any of Clauses 10-15, further comprising a stop member positioned between the at least two movable pulley blocks to prevent the at least two movable pulley blocks from contacting one another.

Clause 17: A method of operating an exercise machine, comprising: (a) setting a locking mechanism on a support frame of the exercise machine to either an unlocked or locked position; (b) pulling an exercise cable relative to a support frame of the exercise machine; and (c) with the locking mechanism in the unlocked position, upon pulling the exercise cable, pulling at least two movable pulley blocks that in turn pulls a weight stack operatively connected to one of the movable pulley blocks via a weight stack cable; or (d) with the locking mechanism in the locked position, upon pulling the exercise cable, pulling one movable pulley block that in turn pulls a weight stack operatively connected to the movable pulley block.

Clause 18: The method of operating an exercise machine as claimed in Clause 17, wherein a first movable pulley block of the at least two movable pulley blocks is operatively connected to the exercise cable and the weight stack cable, wherein a second movable pulley block of the at least two movable pulley blocks is operatively connected to only the exercise cable, and wherein the second movable pulley block is prevented from moving when the locking mechanism is provided in the locked position.

Clause 19: The method of operating an exercise machine as claimed in either Clause 17 or 18, wherein the locking mechanism comprises a handle that is configured to be pulled away from the locking mechanism to unlock the locking mechanism.

Clause 20: The method of operating an exercise machine as claimed in any of Clauses 17-19, wherein the at least two movable pulley blocks are configured to move along at least one guide rail.

These and other features and characteristics of the exercise machine and weight ratio arrangement will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular form of "a", "an", and "the" include plural referents unless the context clearly dictates otherwise.

DESCRIPTION OF THE DISCLOSURE

For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific devices and processes illustrated in the attached drawings, and described in the following specification, are simply exemplary aspects of the disclosure. Hence, specific dimensions and other physical characteristics related to the aspects disclosed herein are not to be considered as limiting.

The present disclosure is directed to, in general, an exercise or weight machine and, more particularly, to a weight ratio arrangement that allows a user to vary a mechanical advantage provided by traditional pulley arrangements on the exercise or weight machines. Certain aspects of the components of the exercise or weight machine and the weight ratio arrangement are illustrated in FIGS. 1-26.

Figure 1:
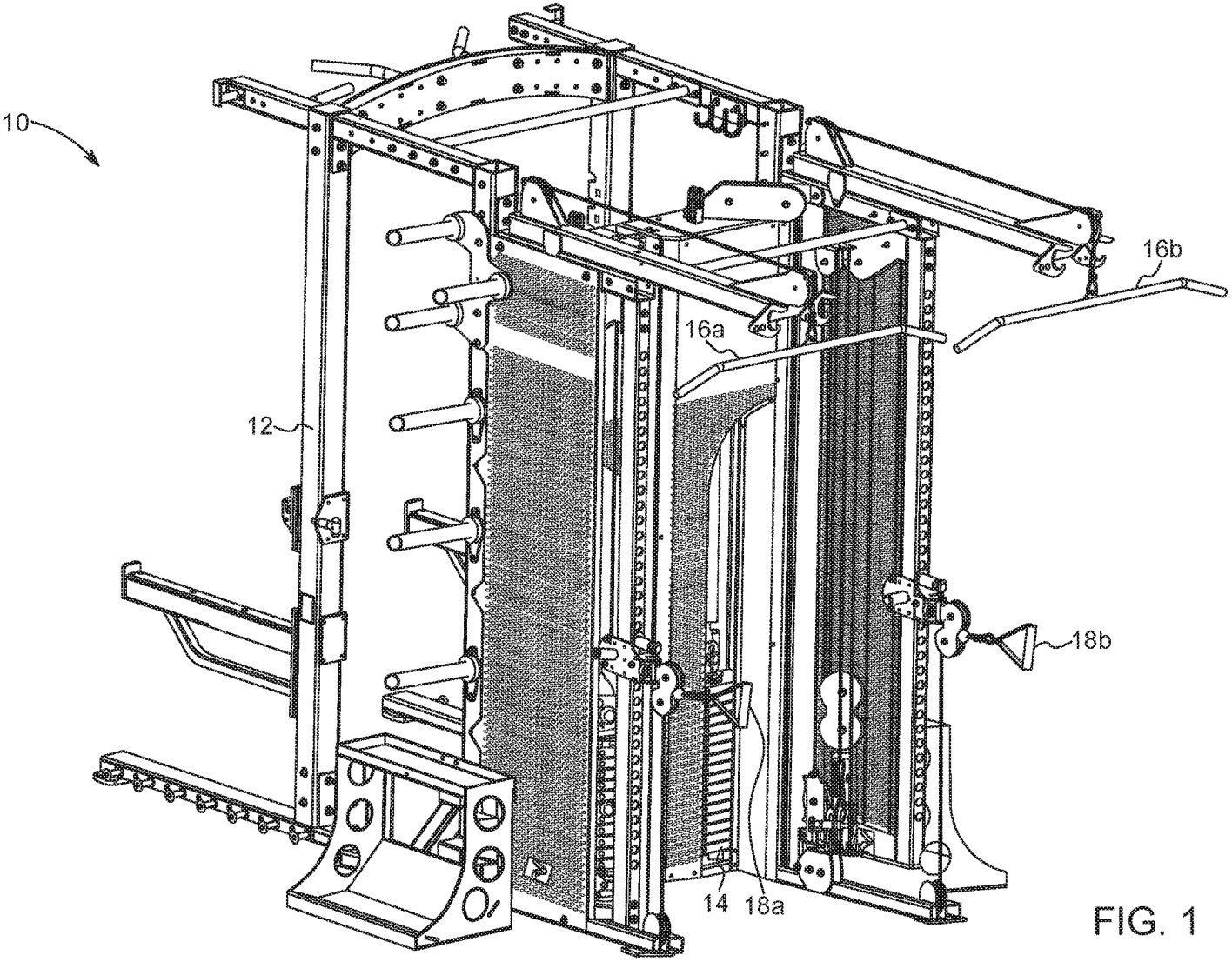
FIG. 1 is a front perspective view of an exercise machine with a ratio device applied to two high-low pulley column machines that are attached to a half rack system.
Figure 2:
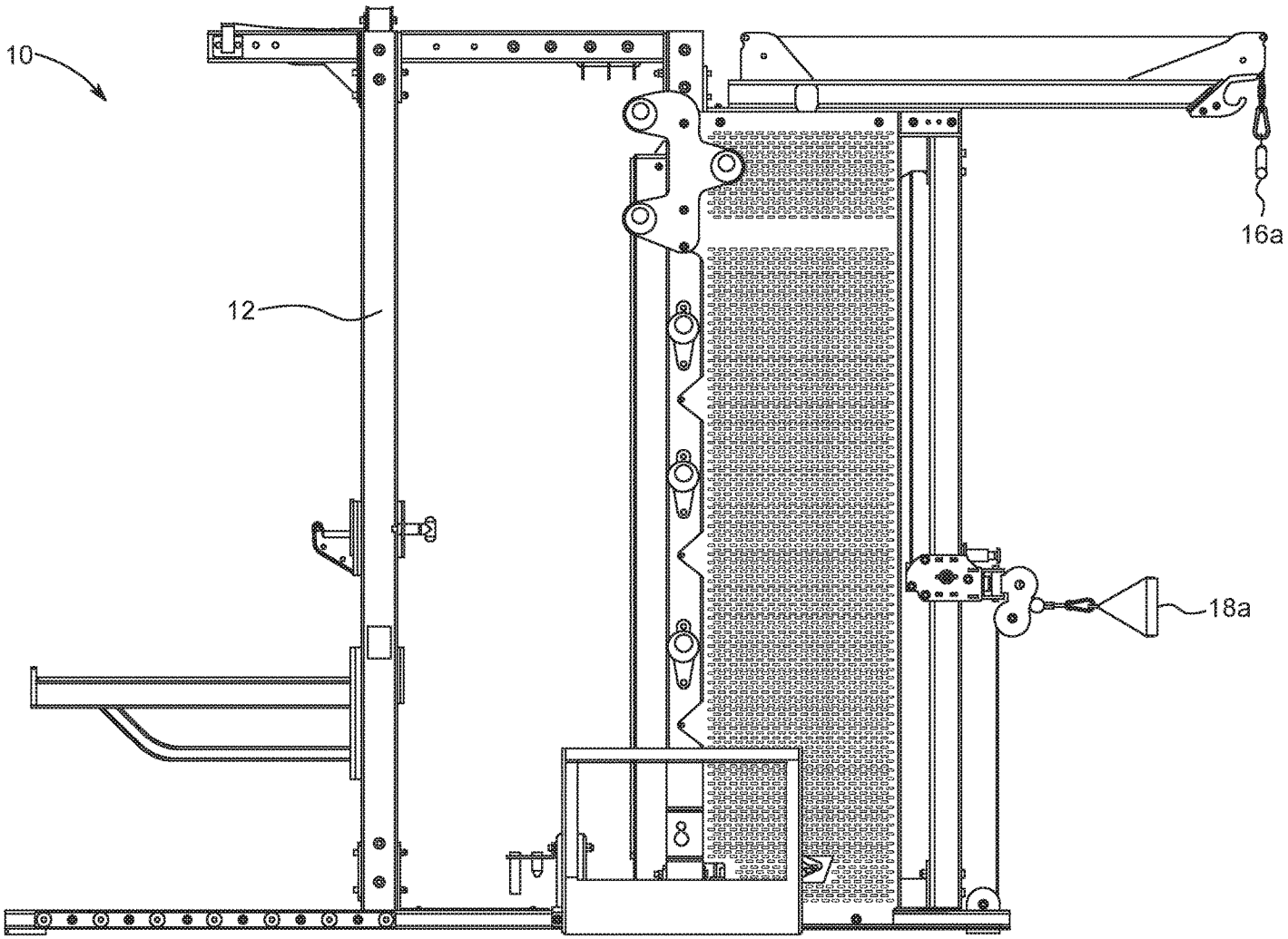
FIG. 2 is a side view of the exercise machine of FIG. 1.
Figure 3:
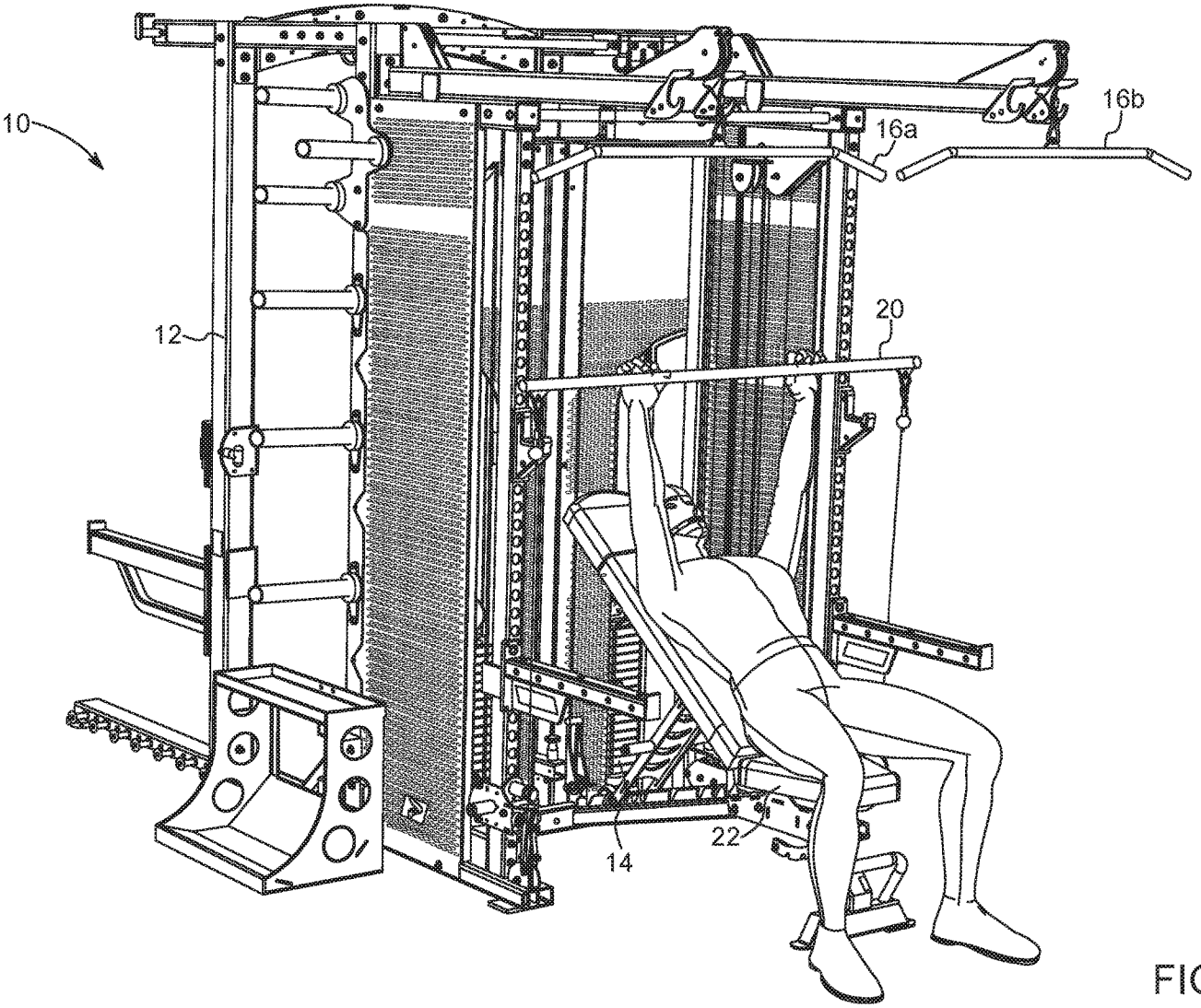
FIG. 3 is a front perspective view showing a user using the exercise machine of FIG. 1 in an inclined position.
Figure 4:
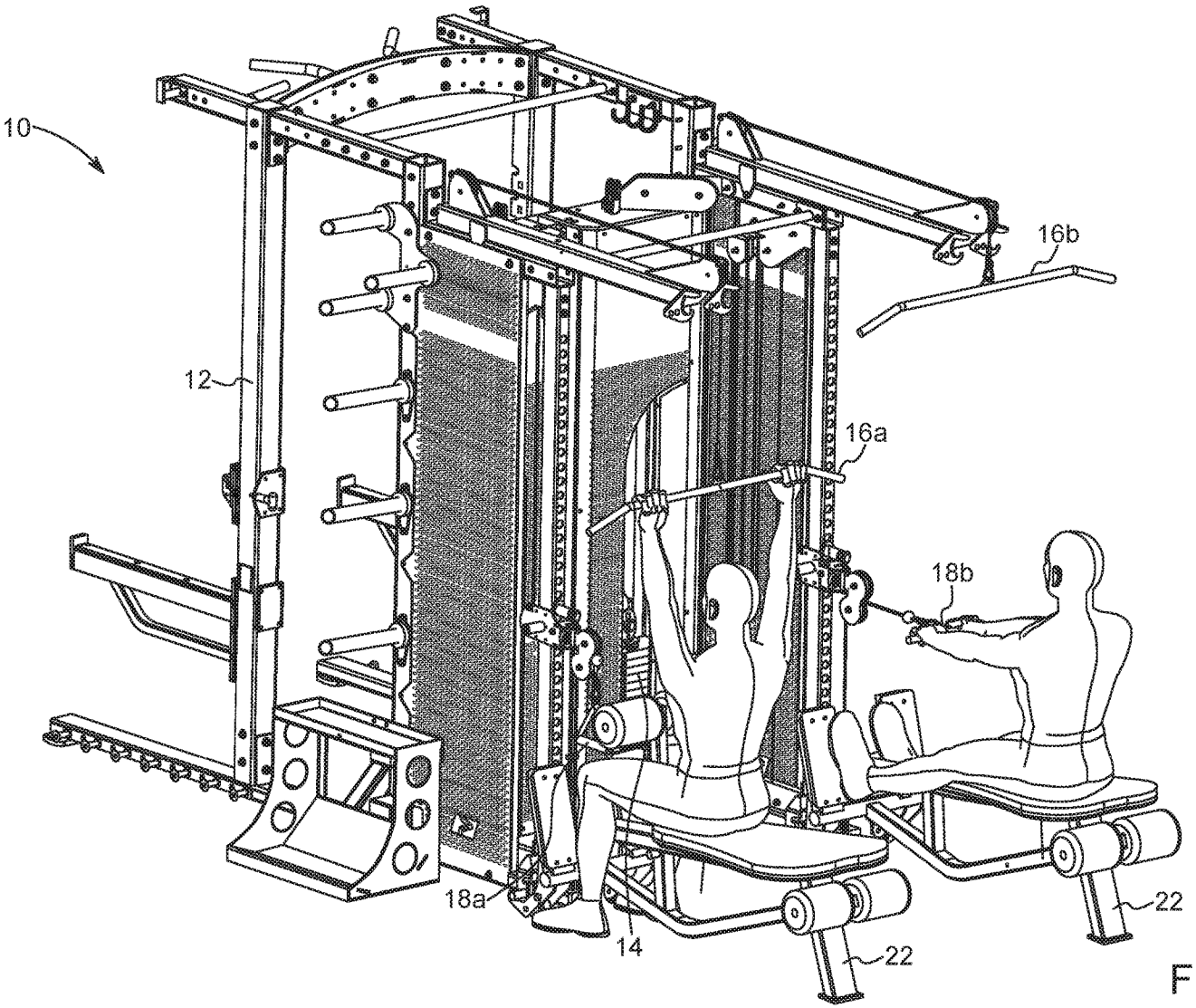
FIG. 4 is a front perspective view showing a plurality of users using the exercise machine of FIG. 1 in different exercising positions.

With reference to FIGS. 1-4, an exercise machine 10 (also referred to as a weight machine or weightlifting machine) which includes several different exercise stations is shown. The exercise machine 10 includes a support frame 12 that houses several different components of the exercise machine 10, including a weight stack 14. It should be understood that although one configuration of a support frame is illustrated in the disclosed embodiment, other configurations of the support frame will be equally suitable for use with the present disclosure. In one exercise station, a lat bar 16*a* and an exercise handle 18*a* are provided to permit different types of exercises for a first user. In an adjacent second exercise station, another lat bar 16*b* and another exercise handle 18*b* are provided to permit different types of exercises for a second user. The user(s) may pull on the lat bars 16*a*, 16*b* and the exercise handles 18*a*, 18*b* to pull a load supplied by the weight stack for exercising. With reference to FIG. 3, it is also contemplated that an exercise bar 20 may be connected with the cable system of the exercise machine 10 instead of the exercise handles 18*a*, 18*b*. The user may sit in an inclined position on an exercise bench 22 connected to the support frame 12 to perform exercises with the exercise bar 20. With reference to FIG. 4, an exercise bench 22 may be provided at each exercise station to permit two users to use the exercise machine 10 at the same time. In this configuration, a first user can use a lat bar 16*a* to exercise, while a second user uses the exercise handle 18*b* to exercise.

Figure 5:
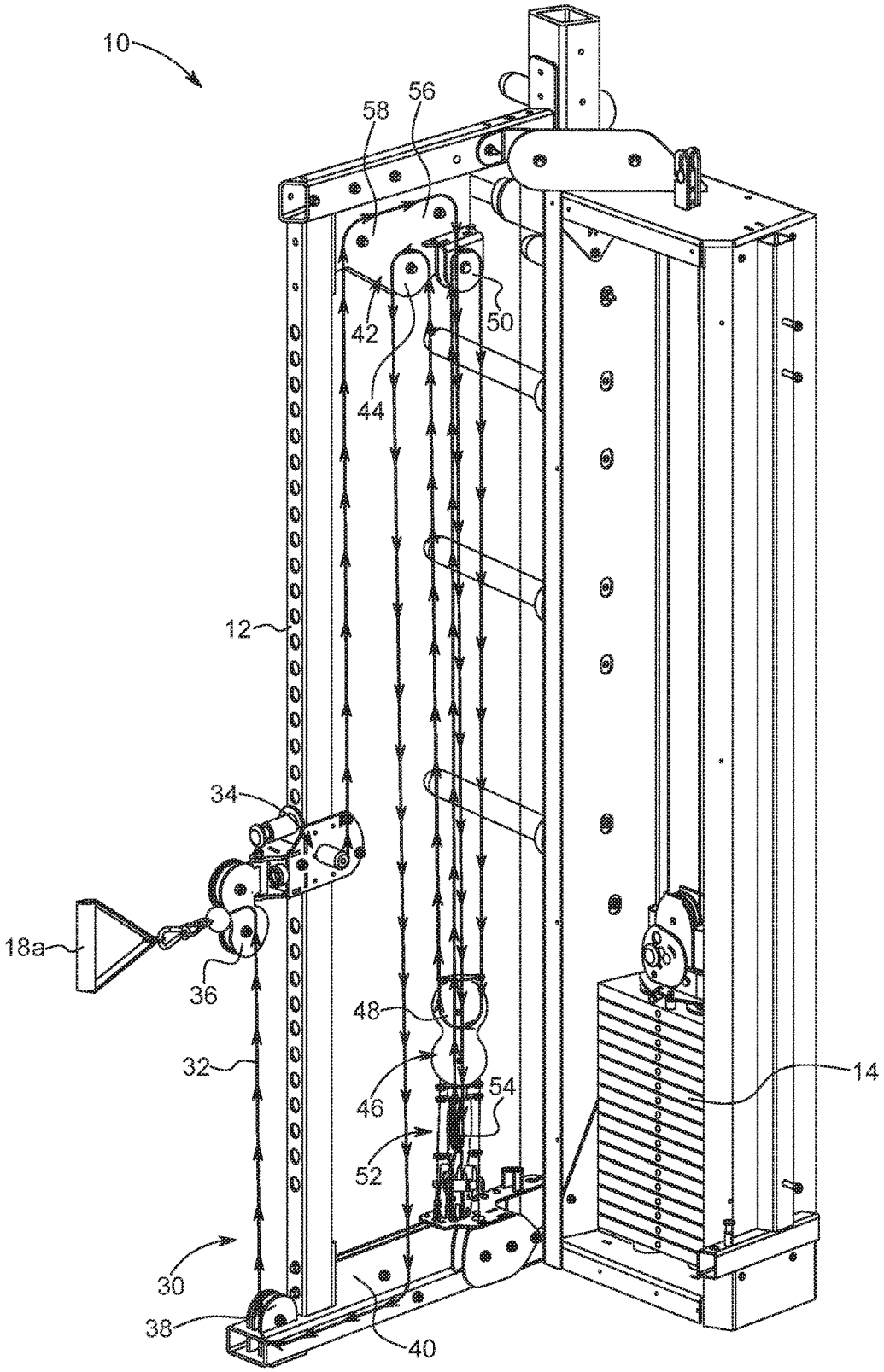
FIG. 5 is a front perspective view of a weight ratio arrangement used in the exercise machine of FIG. 1.
Figure 21A:
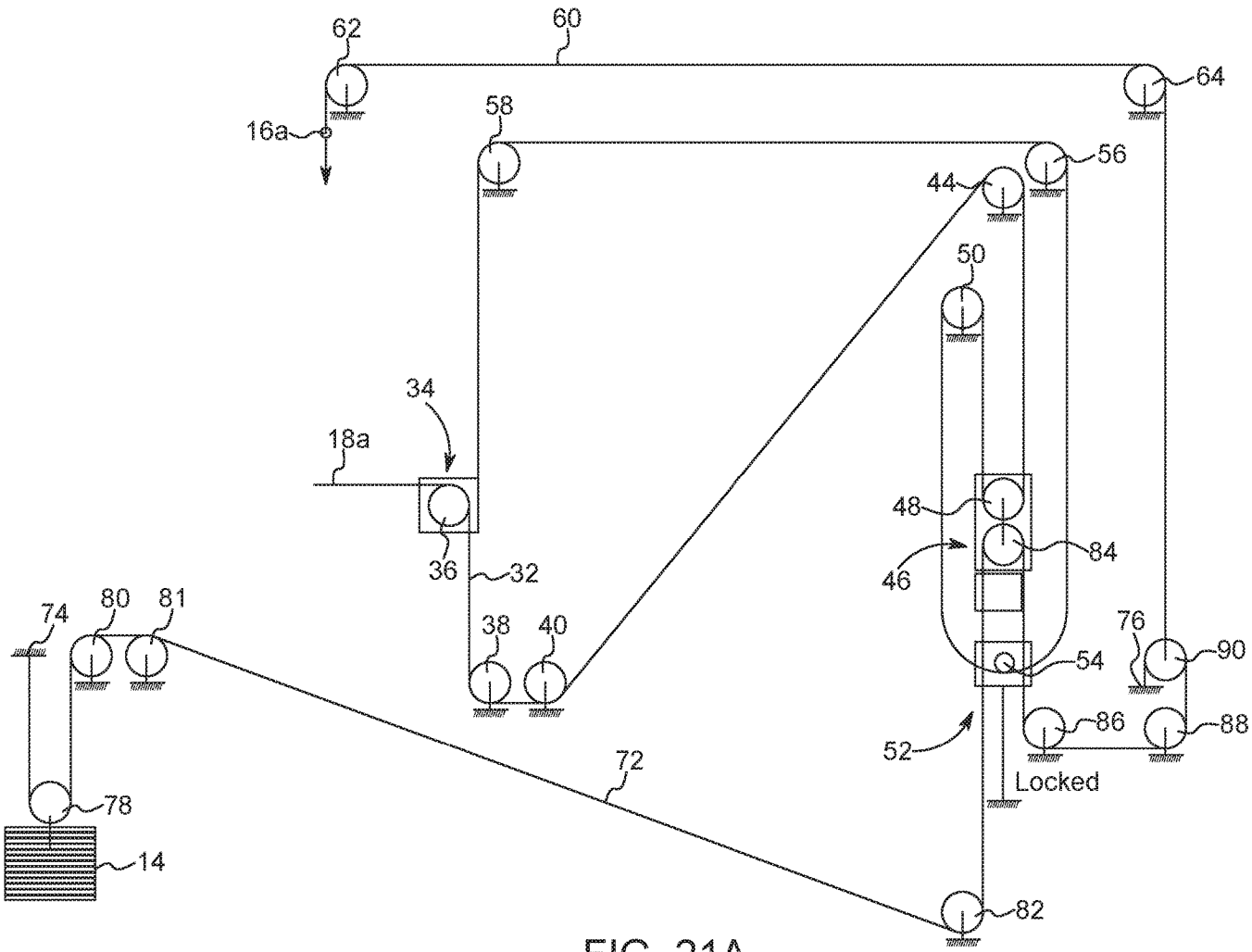
FIG. 21*a* is a schematic illustration of the weight ratio arrangement and weight stack pulley arrangement of FIG. 5 in a 2:1 weight ratio setting.

With reference to FIGS. 5 and 21*a*, a weight ratio arrangement 30 for use in the exercise machine 10 is described. The weight ratio arrangement 30 includes an exercise cable 32 and a plurality of pulleys, as described in further detail below. A first end of the exercise cable 32 is connected to the exercise handle 18*a*. A second opposing end of the exercise cable 32 is connected to a pulley block 34 provided on the support frame 12 of the exercise machine 10. The weight ratio arrangement 30 is provided in the exercise machine 10 to provide resistance against a user's pulling force on the exercise handle 18*a* or lat bar 16*a*. The resistance from the weight ratio arrangement 30 is provided by the weight ratio arrangement's 30 connection with the weight stack 14. The weight ratio arrangement 30 allows a user to adjust the weight ratio that is provided by the weight stack 14 to adjust the amount of force needed from the user to lift the weight stack 14. The pulley block 34 may be vertically adjusted on the support frame 12 into different positions to perform different exercises.

As shown in FIGS. 5 and 21*a*, the exercise cable 32 extends from the exercise handle 18*a* through the pulley block 34 that includes a pulley 36. The exercise cable 32 is guided through the pulley 36 downwardly to a pulley 38 fixed to a bottom portion of the support frame 12. By extending the exercise cable 32 downwardly from the pulley block 34, the exercise cable 32 does not interfere with any bar catch mechanisms (not shown) that may be positioned above the pulley block 34 to hold the exercise bar 20. It is also contemplated that the exercise cable 32 may be directed upwardly from the pulley block 34 to a pulley block 42. The exercise cable 32 is directed through another pulley 40 and then directed upwards to a pulley block 42 fixed to an upper portion of the support frame 12. The exercise cable 32 is directed over a pulley 44 in the pulley block 42. The exercise cable 32 is then directed downward to a top movable pulley block 46. The exercise cable 32 is directed through a top pulley 48 in the top movable pulley block 46 and upwards to another pulley 50 held on the pulley block 42. After being directed through the pulley 50, the exercise cable 32 is again directed downward to a bottom movable pulley block 52. In this configuration, the exercise cable 32 is the cable that interacts with the pulley block 52 so that, in a locked position, the pulley block 52 has no bearing on the weight ratio of the machine and, in the unlocked position, the pulley block 52 cuts the weight ratio in half by being pulled along with the pulley block 46 and adding cable pull travel to the exercise handle 18*a* and at the same time reducing the load the user feels pulling on the exercise handle 18*a*. The exercise cable 32 is directed through a pulley 54 and upward to the pulley block 42. The exercise cable 32 is directed over two pulleys 56, 58 housed within the pulley block 42 and downward to be fixed to the pulley block 34.

With reference to FIGS. 7, 10, 11, and 21*a*, an arrangement for a lat bar cable 60 and pulley system is described. One end of the lat bar cable 60 is connected to the lat bar 16*a* and an opposing second end of the lat bar cable 60 is fixed to a floating pulley block 70 in a lower portion of the support frame 12. From the lat bar 16*a*, the lat bar cable 60 is directed over a first pulley 62 provided on an upper portion of the support frame 12 and over another pulley 64 provided on an opposing end of the support frame 12. Each pulley 62, 64 is housed within a pulley block 66, 68. The lat bar cable 60 is then directed downward to connect to the pulley block 70 provided on a bottom portion of the support frame 12.

Figure 7:
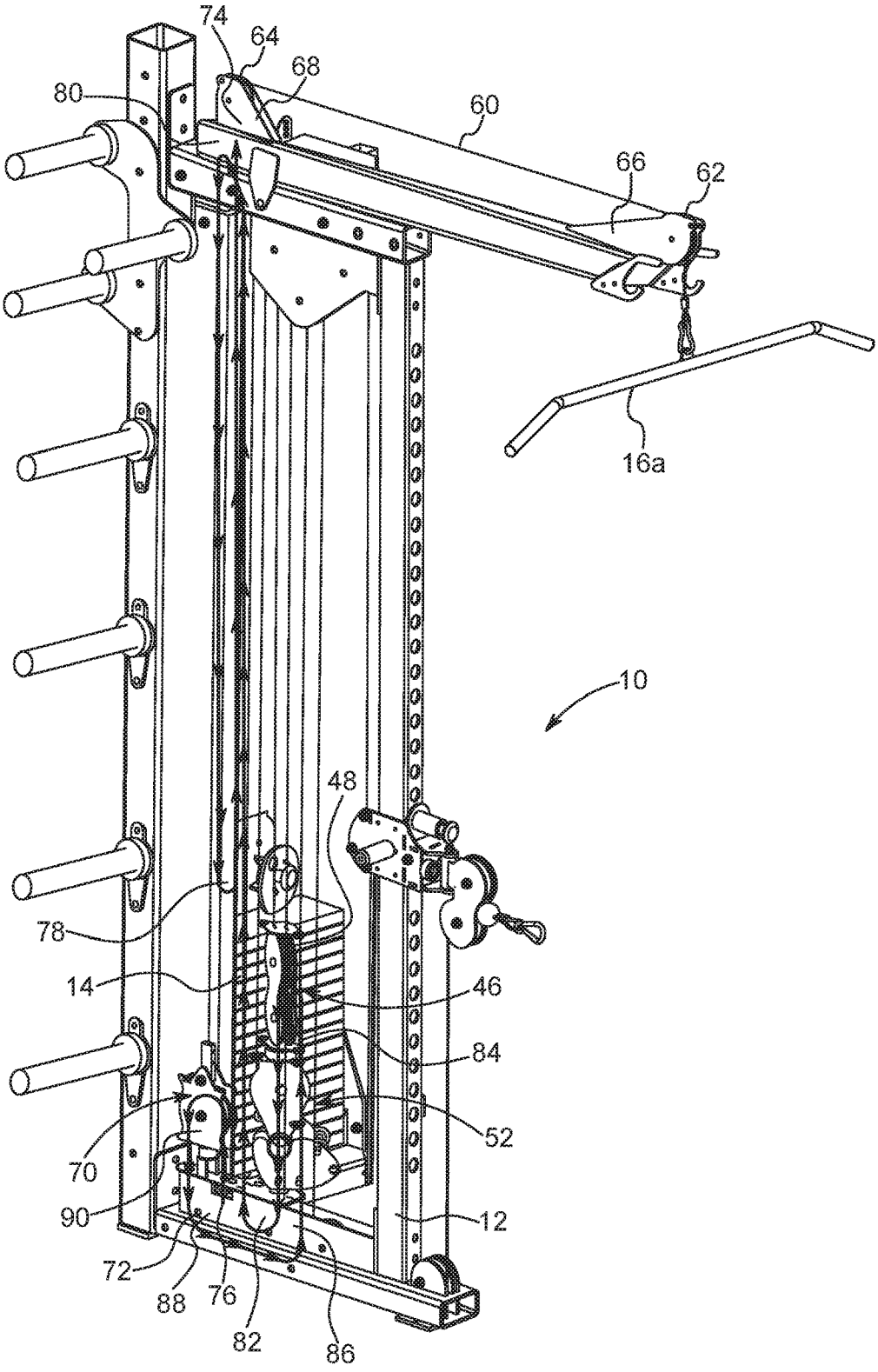
FIG. 7 is a front perspective view of the weight ratio arrangement and weight stack pulley arrangement of FIG. 5 connected to a lat bar with a 1:1 weight ratio.

With continued reference to FIGS. 7 and 21*a*, an arrangement for a weight stack cable 72 and pulley system is described. One end of the weight stack cable 72 is fixed to an upper frame member of the support frame 12 at a fixing point 74 and an opposing second end of the weight stack cable 72 is fixed to a bottom frame member of the support frame 12 at a fixing point 76. From the fixing point 74, the weight stack cable 72 extends downward to a pulley 78 fixed to the weight stack 14. The weight stack cable 72 is then directed through the pulley 78 and upward to another pulley 80 held in the support frame 12. After being directed through the pulley 80, the weight stack cable 72 is directed downward toward a pulley 82 held in a bottom frame member of the support frame 12. The weight stack cable 72 is directed through the pulley 82 and upwards to the top moveable pulley block 46. The weight stack cable 72 is directed over a lower pulley 84 provided in the top moveable pulley block 46. Therefore, the weight stack cable 72 interacts with the lower pulley 84 provided in the pulley block 46 and the exercise cable 32 interacts with the top pulley 48 in the pulley block 46. After being directed over the lower pulley 84, the weight stack cable 72 is directed downward to extend over two pulleys 86, 88 fixed on a bottom frame member of the support frame 12. The two pulleys 86, 88 are spaced from one another on the support frame 12. The weight stack cable 72 is then directed over a pulley 90 in the floating pulley block 70 and connected to the fixing point 76.

Figure 6:
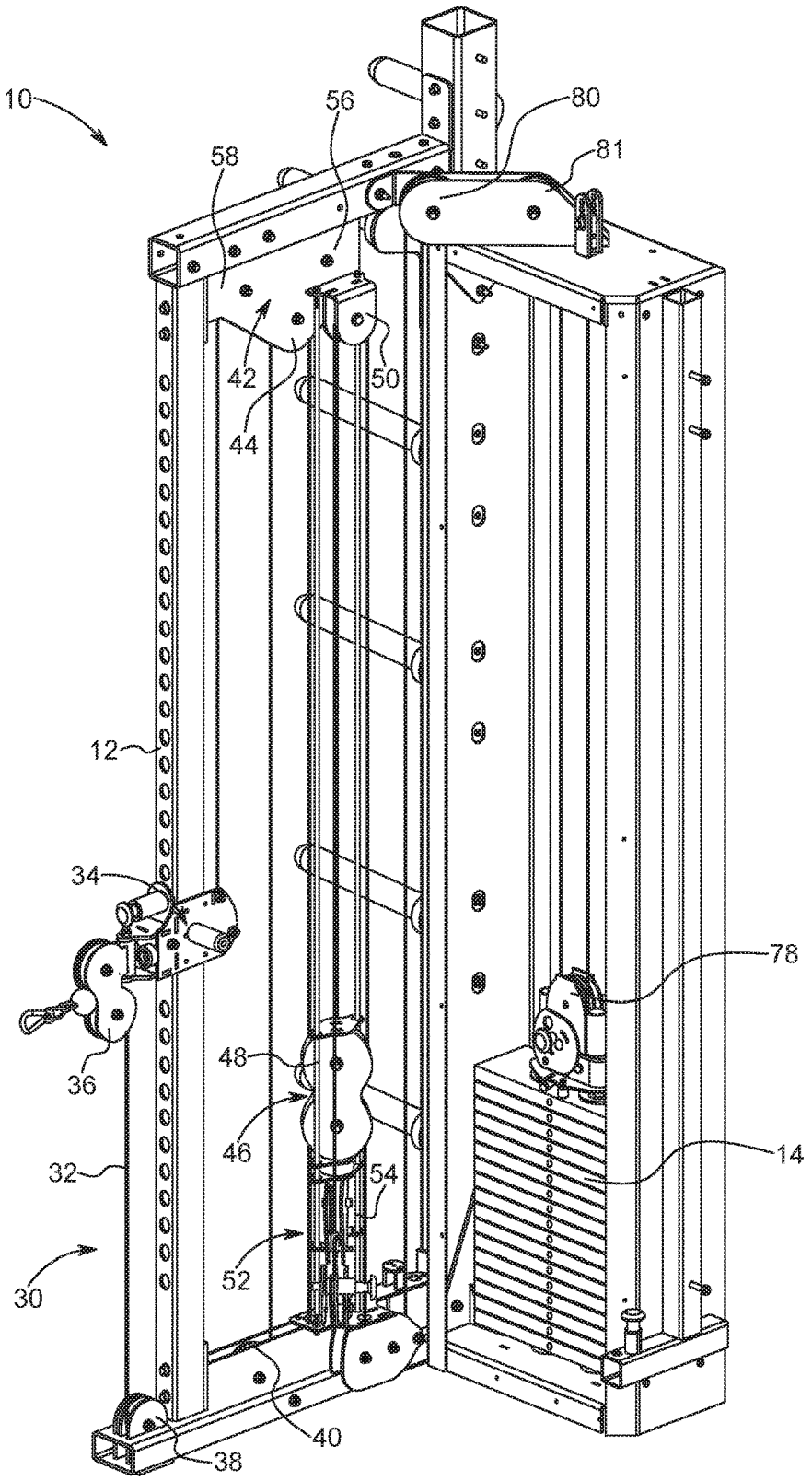
FIG. 6 is another front perspective view of the weight ratio arrangement shown in FIG. 5 along with a weight stack pulley arrangement.
Figure 8:
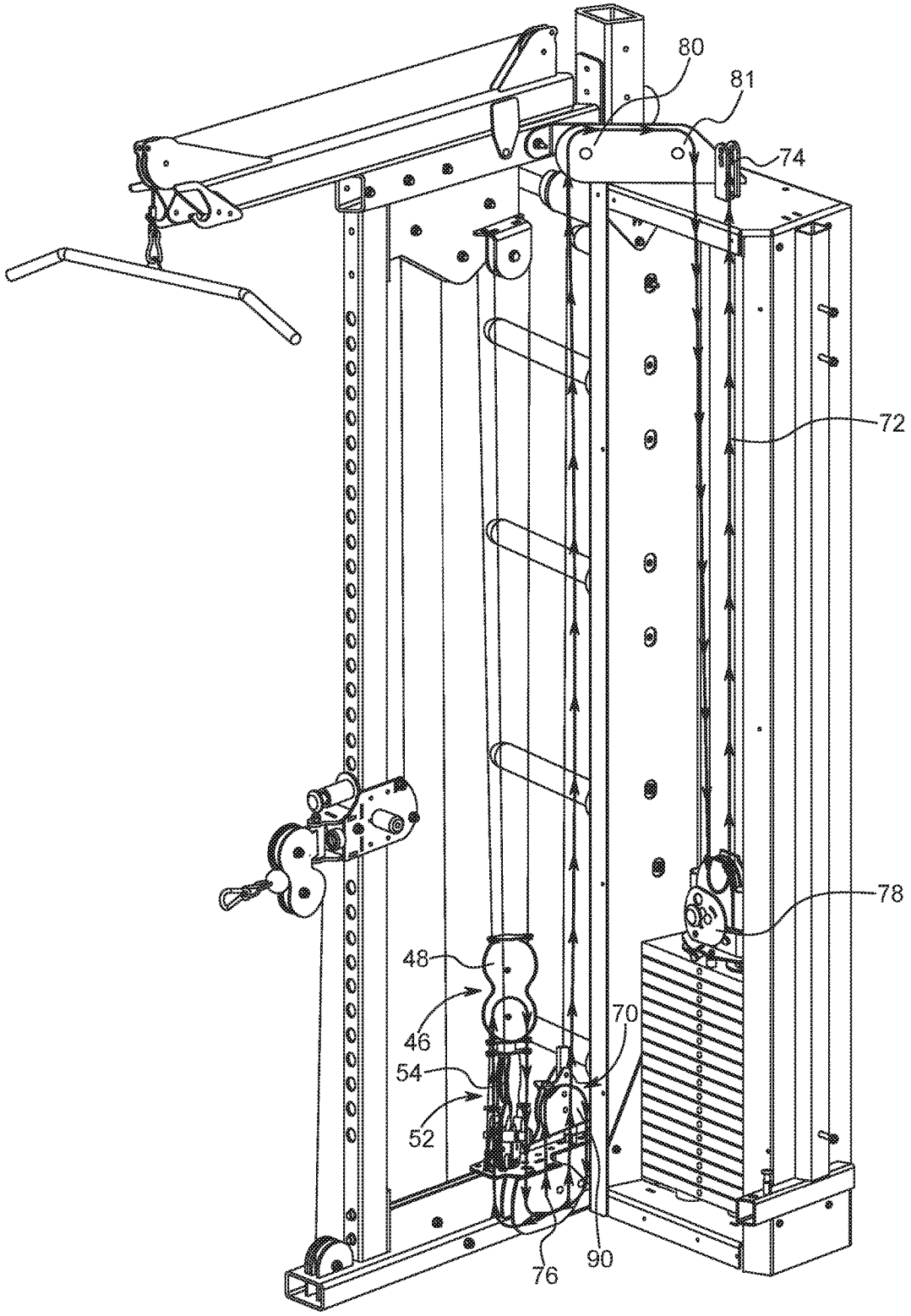
FIG. 8 is another front perspective view of the weight ratio arrangement and weight stack pulley arrangement of FIG. 5 connected to a lat bar with a 1:1 weight ratio.
Figure 9:
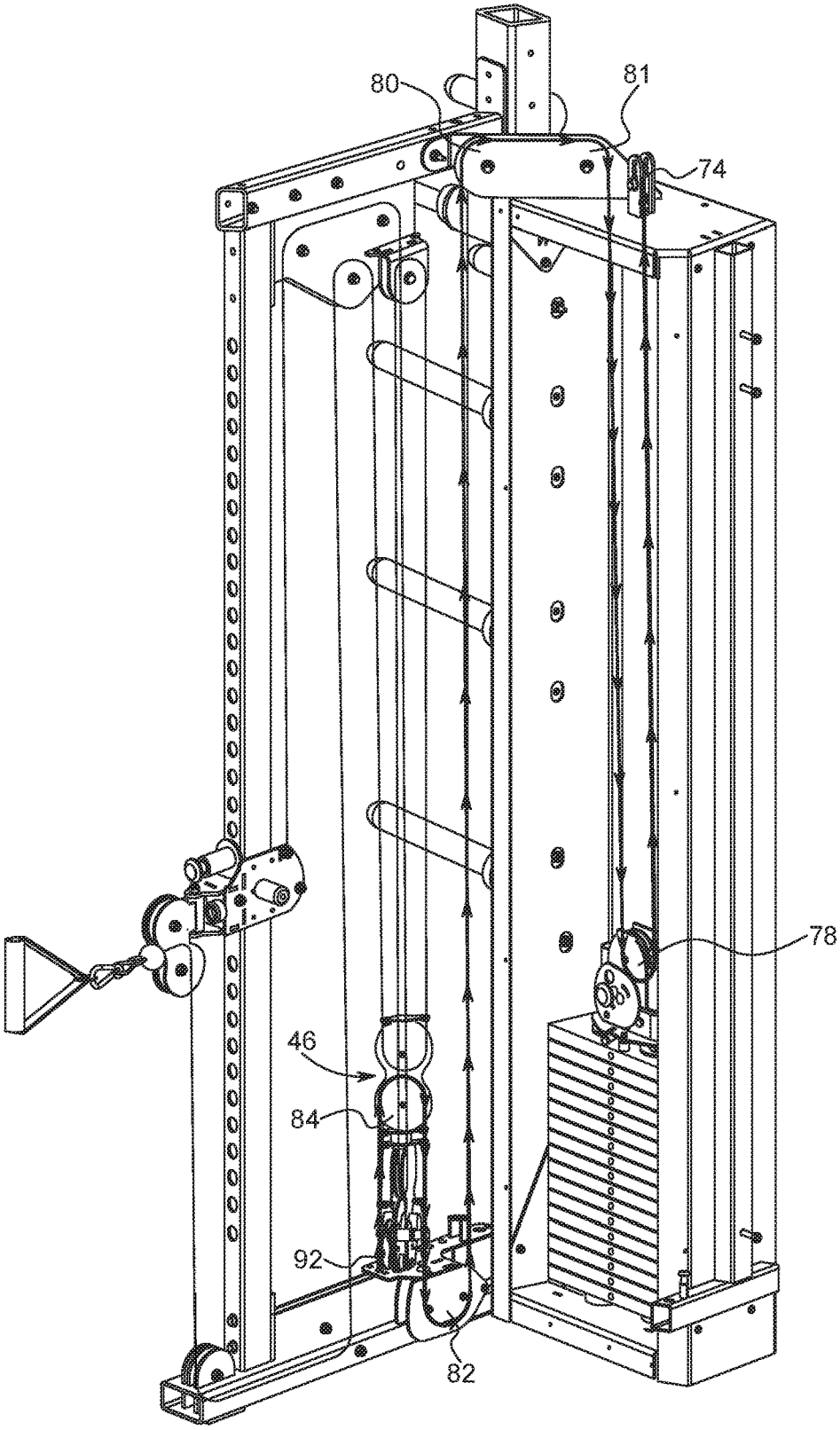
FIG. 9 is a front perspective view of the weight ratio arrangement and weight stack pulley arrangement of FIG. 5 without the lat bar.
Figure 10:
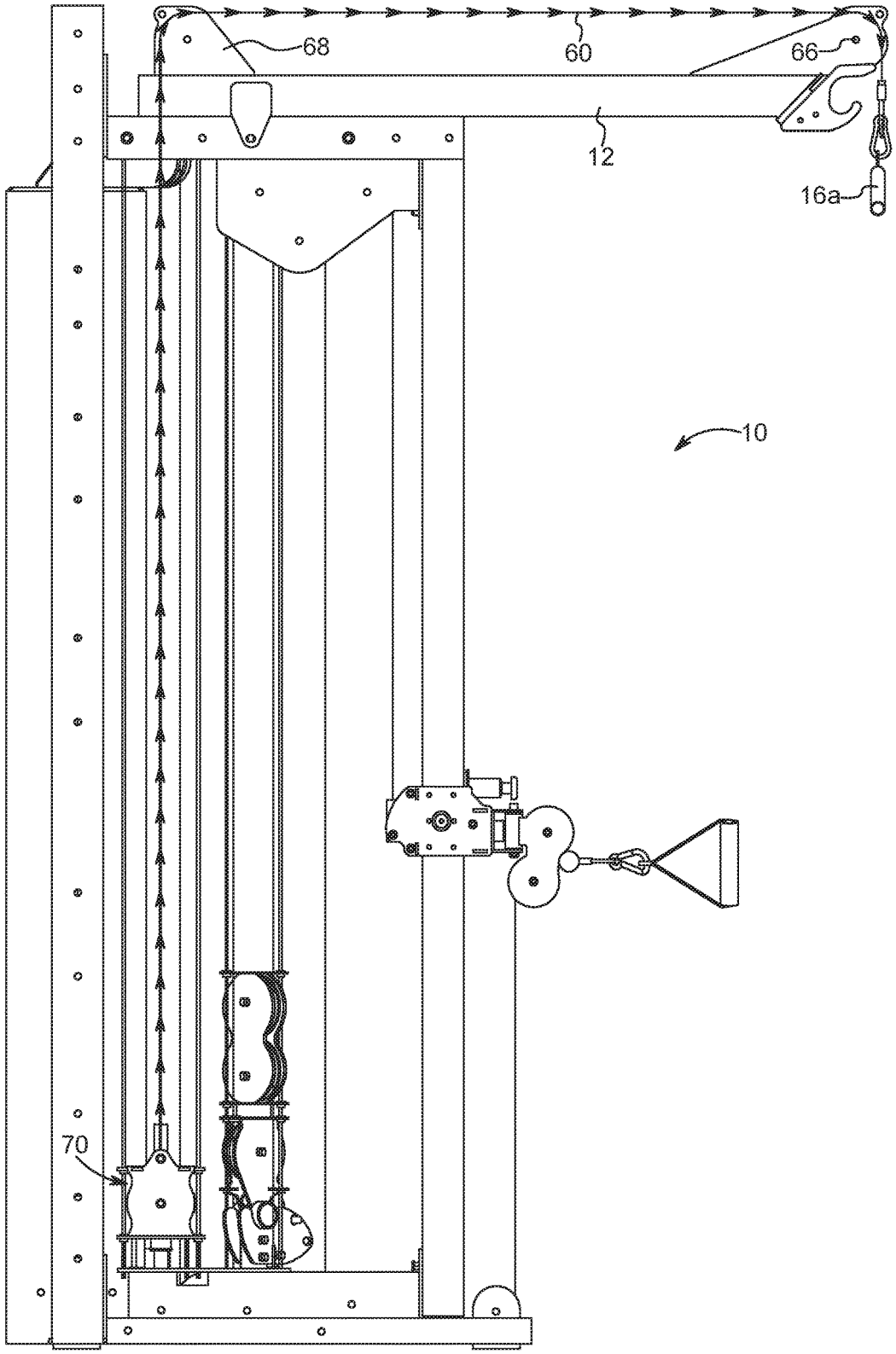
FIG. 10 is a side view of the weight ratio arrangement and weight stack pulley arrangement of FIG. 5 connected to a lat bar with a 1:1 weight ratio.
Figure 11:
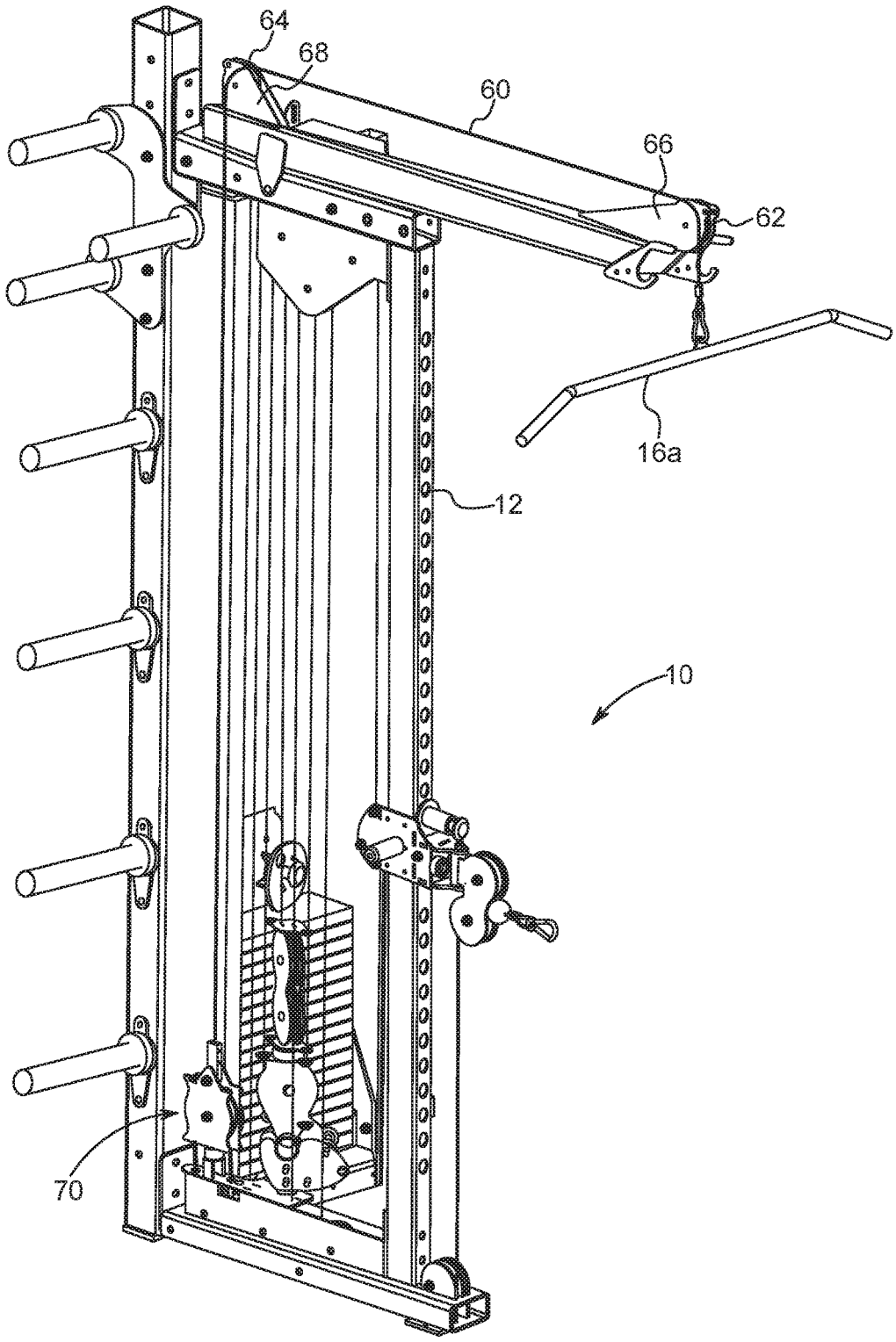
FIG. 11 is a front perspective view the weight ratio arrangement of FIG. 5 connected to a lat bar with a 1:1 weight ratio.

Alternative arrangements of the cable and pulley systems are provided in the remaining figures. With reference to FIGS. 6 and 8, the single pulley 80 of the weight stack cable 72 pulley arrangement may be provided with an additional pulley 81. The extra pulley 81 assists in directing the weight stack cable 72 across the support frame 12 to be directed downward to the pulley 82. With reference to FIG. 9, an alternate arrangement for the weight stack cable 72 is shown. The weight stack cable 72 may extend from the fixing point 74 to the pulley 78. The weight stack cable 72 is then directed over the two pulleys 80, 81 and downward to the next pulley 82. The weight stack cable 72 is then directed upward to the bottom pulley 84 in the top moveable pulley block 46. Then, instead of the weight stack being directed downward to the next pulley 86, the weight stack cable 72 is directed downward to be fixed to a bottom frame member of the support frame 12 at a fixing point 92.

Figure 22:
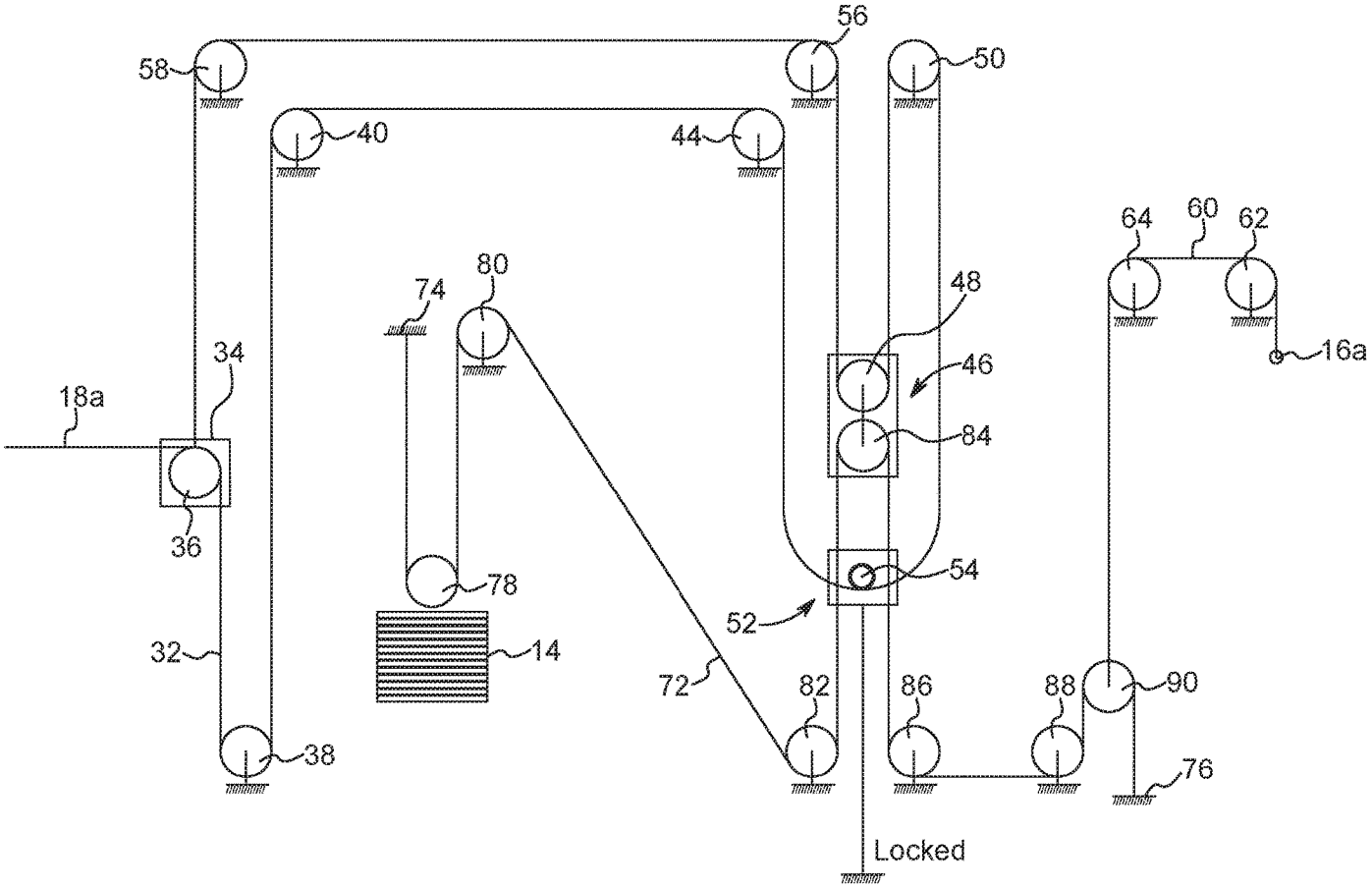
FIG. 22 is a schematic illustration of a weight ratio arrangement in a 2:1 weight ratio setting according to another aspect of the disclosure.
Figure 23:
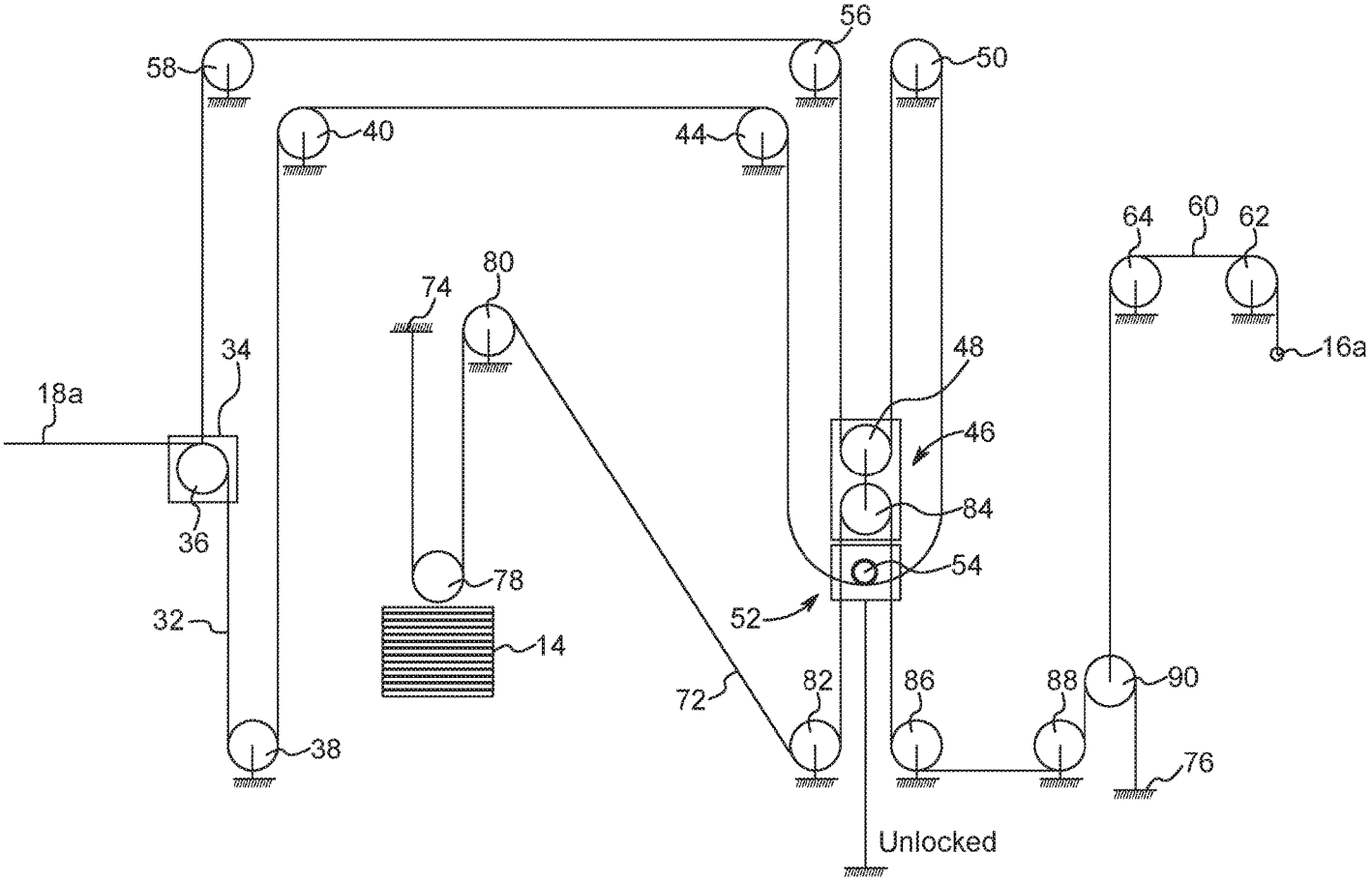
FIG. 23 is a schematic illustration of the weight ratio arrangement of FIG. 22 in a 4:1 weight ratio setting.

With reference to FIGS. 22 and 23, another configuration for the exercise cable 32 and pulley system is shown. In this configuration, the pulley 40 has been moved to an upper frame member of the support frame 12, so that, after the exercise cable 32 has been directed through the pulley 38, the exercise cable 32 is directed upwards to the pulley 40. The exercise cable 40 is then directed across the support frame 12 to the pulley 44. Additionally, the exercise cable 32 is then directed downward to the pulley 54 in the bottom movable pulley block 52, instead of the upper pulley 48 in the top movable pulley block 46. The exercise cable 32 is then directed upwards to the pulley 50. Next, the exercise cable 32 is directed downward to the top movable pulley block 46 to be directed through the upper pulley 48. The exercise cable 32 is then directed upward to the pulley 56 and over to the pulley 58. Lastly, the exercise cable 32 is connected to the pulley block 34. Using this configuration, the weight of the weight stack 14 is cut to a weight ratio of 1:4 when the user is using the exercise handle 18*a* and the bottom pulley block 52 is unlocked and a 1:2 weight ratio when the bottom pulley block 52 is locked. The load at the exercise handle 18*a* would be a 1:1 ratio when the bottom pulley block 52 is in a locked position. The lat bar 16*a* would always remain at a 1:1 ratio because the lat bar cable 60 passes through the pulley block 54 as if it were part of the support frame 12.

Figure 24:
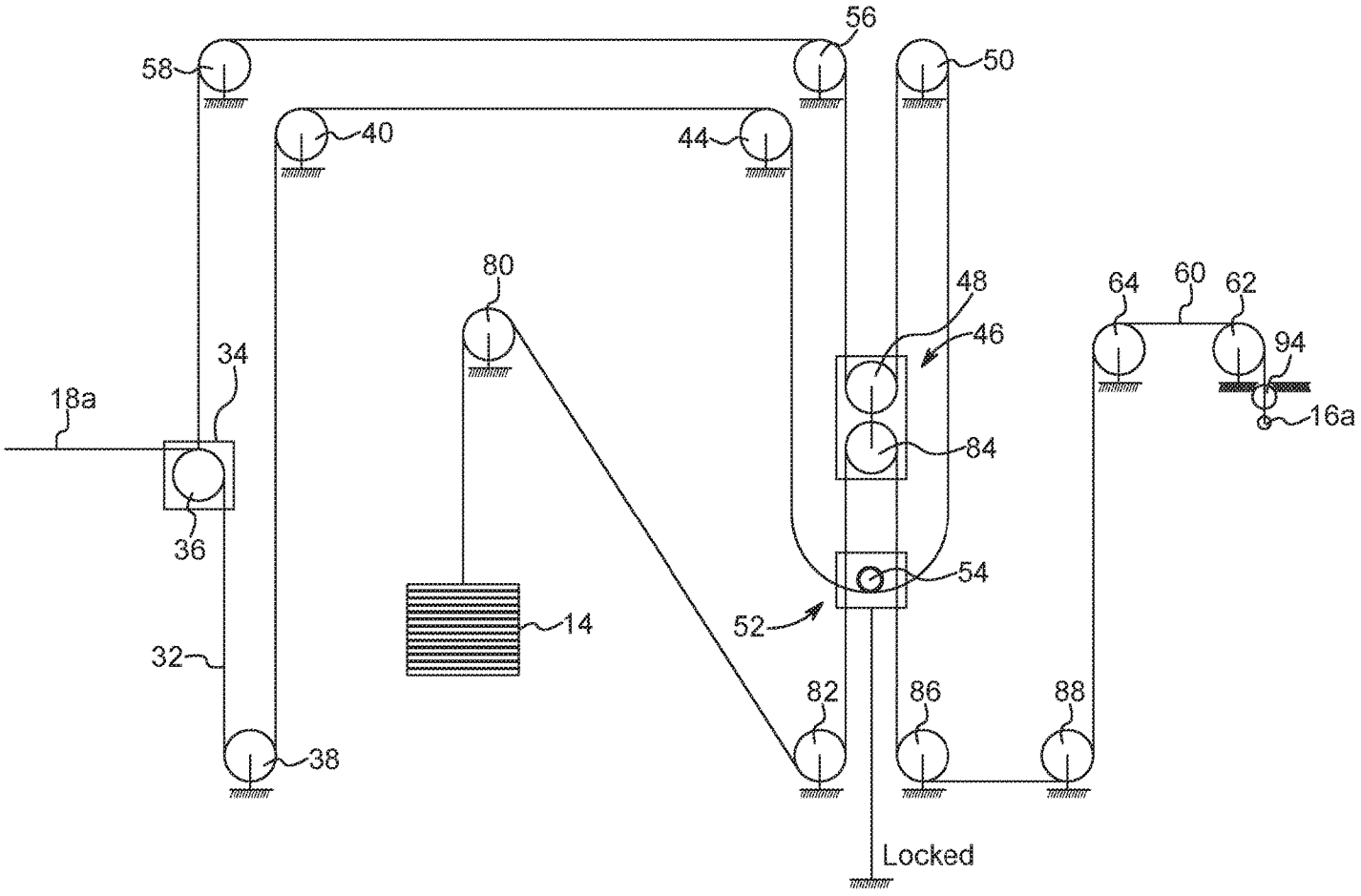
FIG. 24 is a schematic illustration of a weight ratio arrangement in a 1:1 weight ratio setting in a locked position without the use of an optional pulley on the weight stack.
Figure 25:
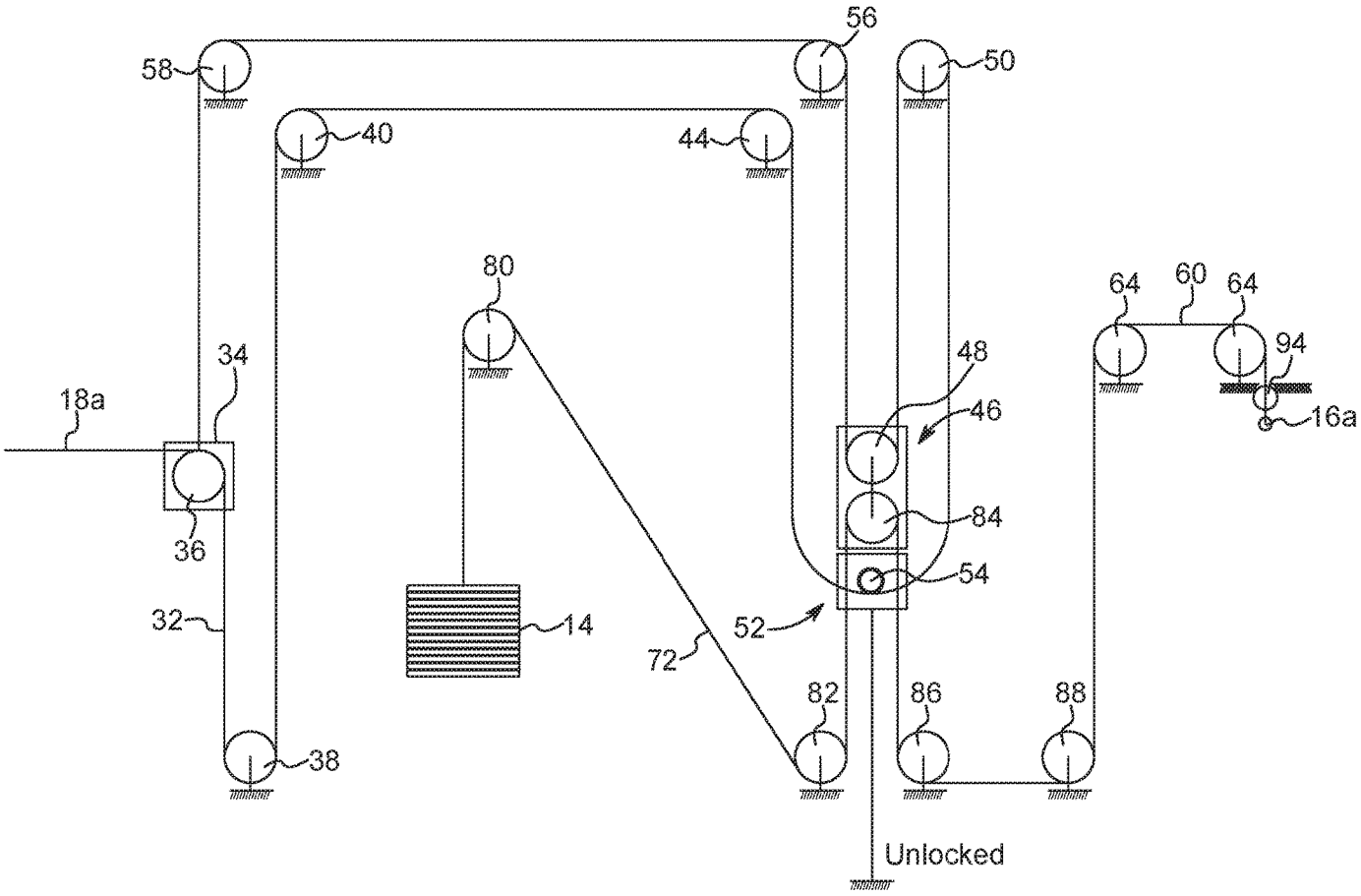
FIG. 25 is a schematic illustration of the weight ratio arrangement of FIG. 24 in a 2:1 weight ratio setting for an exercise handle and a 1:1 weight ratio setting for a lat bar in an unlocked position without the use of an optional pulley on the weight stack.

With reference to FIGS. 24 and 25, another configuration of the weight stack cable 72 and pulley system is shown. In this configuration, the weight stack pulley 78 is no longer provided. Instead, the end of the weight stack cable 72 is fixed directly to the weight stack 14. Using this configuration, the weight of the weight stack 14 compared to the weight of the exercise handle 18*a* is a 1:1 weight ratio when the bottom pulley block 52 is locked (see FIG. 24) and the weight ratio would be 2:1 when the bottom pulley block 52 is unlocked (see FIG. 25). In this configuration, the lat bar 16*a* is directly attached to the weight stack 14. Therefore, the lat bar cable 60 extends from the lat bar 16*a* over the pulleys 62, 64 and downward to the pulley 88. The lat bar cable 60 is directed over the pulleys 88 and 86 and directed upwards to the bottom pulley 84 in the top movable pulley block 46. The lat bar cable 60 is then directed downwards to the pulley 82 and up to the pulley 80. The lat bar cable 60 is directed over the pulley 80 and fixed directly to the weight stack 14. Using this configuration of the lat bar cable 60 and pulley system, a 1:1 weight ratio may be provided for the user using the lat bar 16*a*. In this configuration, a cable stop 94 is provided on the support frame 12 near the lat bar 16*a* so that the lat bar cable 60 can only be pulled out of the support frame 12 and does not fall into the support frame 12.

Figure 26:
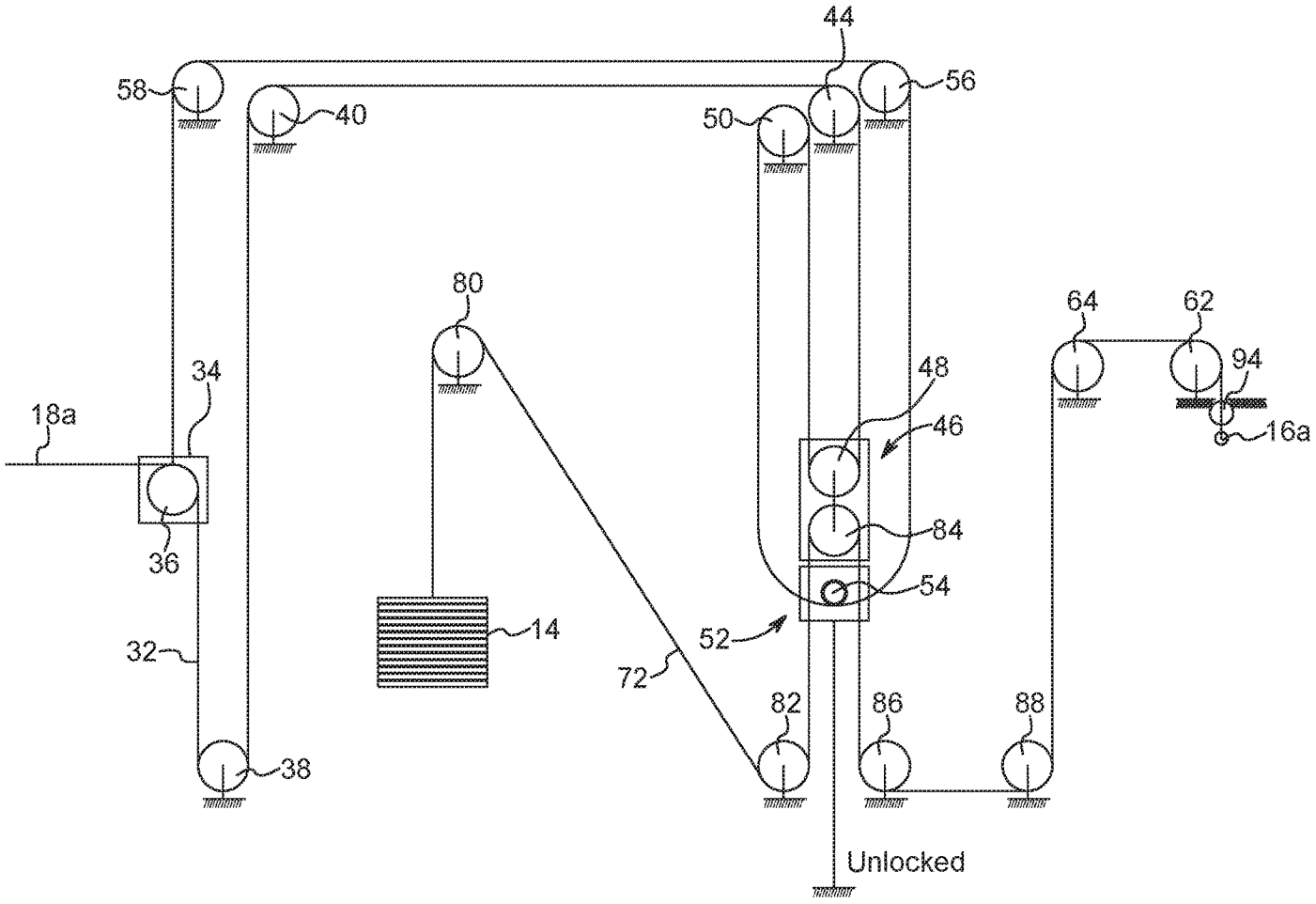
FIG. 26 is a schematic illustration of a weight ratio arrangement with an alternate routing of the exercise cable according to another aspect of the disclosure.

With reference to FIG. 26, another configuration of the exercise cable 32 and pulley system is shown. In this configuration, the exercise cable 32 is directed to the top pulley 48 of the top movable pulley block 46 before the pulley 54 of the bottom movable pulley block 52. Therefore, the exercise cable 32 runs from the pulley 36 downward to the pulley 38. The exercise cable 32 is then directed upward to the pulley 40 and across to the pulley 44. Next, unlike the configuration shown in FIG. 22, the exercise cable 32 is directed downward to the upper pulley 48 of the top movable pulley block 46. The exercise cable 32 is then directed upward to the pulley 50 and downward to the pulley 54 in the bottom movable pulley block 52. The exercise cable 32 is then directed upwards to the pulley 56 and across the support frame 12 to the pulley 58. Finally, the exercise cable 32 is connected to the pulley block 34.

Figure 12:
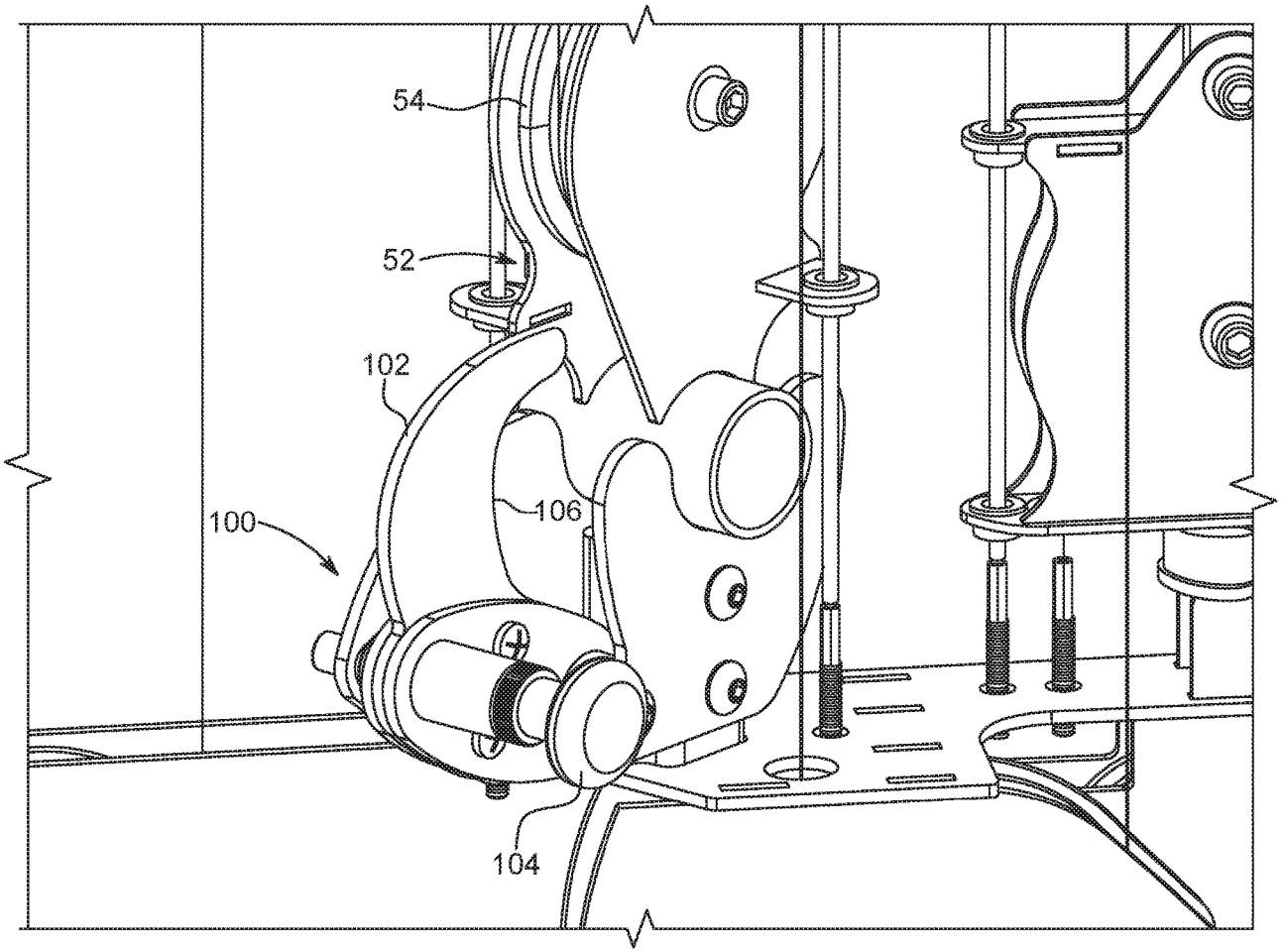
FIG. 12 is a perspective view of a pulley block locking mechanism in an unlocked position according to an aspect of the disclosure.
Figure 13:
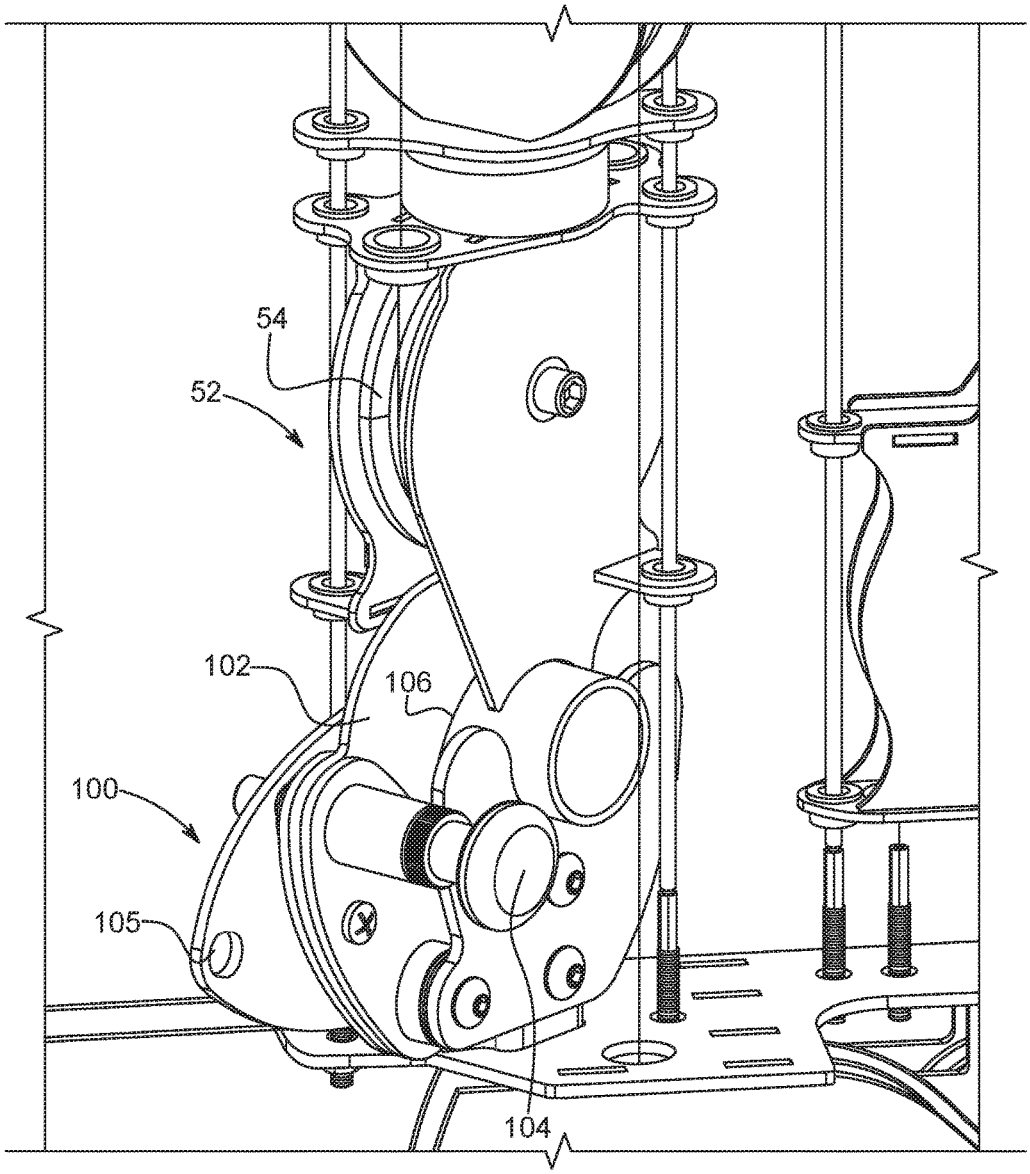
FIG. 13 is a perspective view of the pulley block locking mechanism of FIG. 12 in a locked position.

With reference to FIGS. 12 and 13, a pulley block locking mechanism 100 for the weight ratio arrangement 30 is shown. The pulley block locking mechanism 100 is fixed to the support frame 12 and is configured to prevent and permit movement of the bottom movable pulley block 52. The pulley block locking mechanism 100 may include a latching lever 102 that is rotatable between a locked position and an unlocked position. A handle 104 is provided to assist the user in moving the latching lever 102 between the locked and unlocked positions. The handle 104 may be spring-loaded to remain in a locked position on the locking mechanism 100. The handle 104 may be pulled out so allow the user to move the locking mechanism 100 to a different position. Upon release, the handle 104 is sprung back into place in an aperture 105 defined in the locking mechanism 100. Two apertures 105 are provided corresponding to a locked position of the locking mechanism 100 and an unlocked position of the locking mechanism 100. It is also contemplated that any other mechanisms could be used to move the latching lever 102 between the locked and unlocked positions. The latching lever 102 has a curved inner surface 106 that is configured to latch onto a portion of the bottom movable pulley block 52. As shown in FIG. 12, when the latching lever 102 is rotated away from the bottom movable pulley block 52, the bottom movable pulley block 52 is movable in a vertical direction once a user pulls the exercise handle 18*a* from the support frame 12, which will be described in greater detail below. As shown in FIG. 13, when the latching lever 102 is rotated towards the bottom movable pulley block 52 so that the inner surface 106 contacts a portion of the bottom movable pulley block 52, the bottom movable pulley block 52 is prevented from moving in a vertical direction once a user pulls the exercise handle 18*a* from the support frame 12, which will be described in greater detail below.

Figure 14:
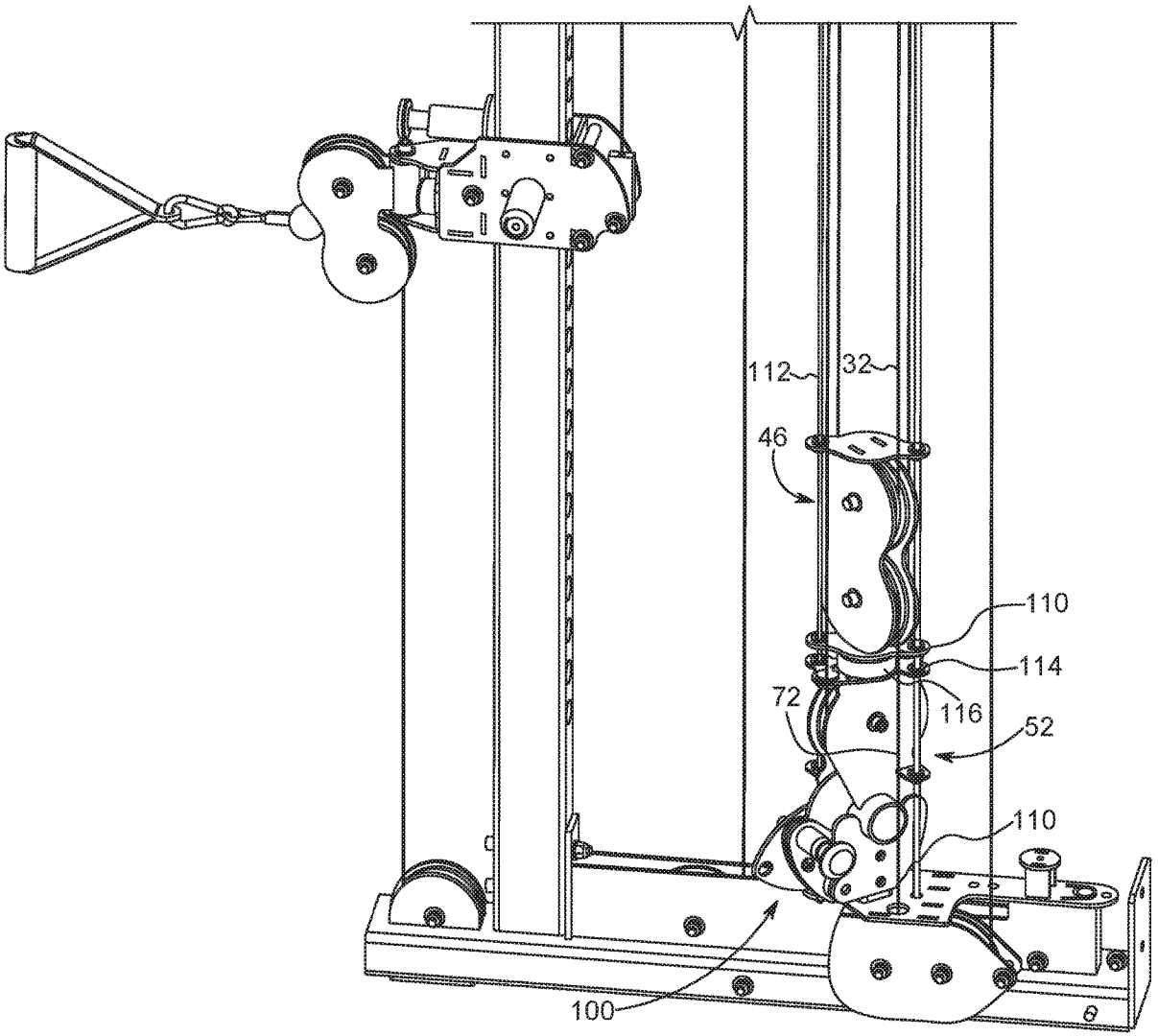
FIG. 14 is a side view showing the weight ratio arrangement of FIG. 5.

With reference to FIG. 14, a pair of guide rods 110, 112 may be provided on the support frame 12 to guide the top movable pulley block 46 and the bottom movable pulley block 52 in a vertical direction during use of the exercise machine 10. The guide rods 110, 112 are generally cylindrical in shape and extend from a top frame member to a bottom frame member of the support frame 12. The guide rods 110, 112 may be formed integral with the support frame 12 or may be removably connected to the frame members of the support frame 12. The guide rods 110, 112 extend through bushings 114 provided on the top movable pulley block 46 and the bottom movable pulley block 52. The guide rods 110, 112 are provided to prevent the movable pulley block 46, 52 from moving in a horizontal direction during use of the exercise machine 10, which helps to prevent the movable pulley blocks 46, 52 from contact the exercise cable 32 or weight stack cable 72. Also shown in FIG. 14 is a stop member 116 that may be provided between the movable pulley blocks 46, 52 to prevent the movable pulley blocks 46, 52 from contacting one another during use of the exercise machine 10. The stop member 116 may be made of rubber or any other material that assists in cushioning the top movable pulley block 46 against the bottom movable pulley block 52. The stop member 116 may be fixed on a bottom surface of the top movable pulley block 46 or may be fixed to a top surface of the bottom movable pulley block 52.

Figure 15:
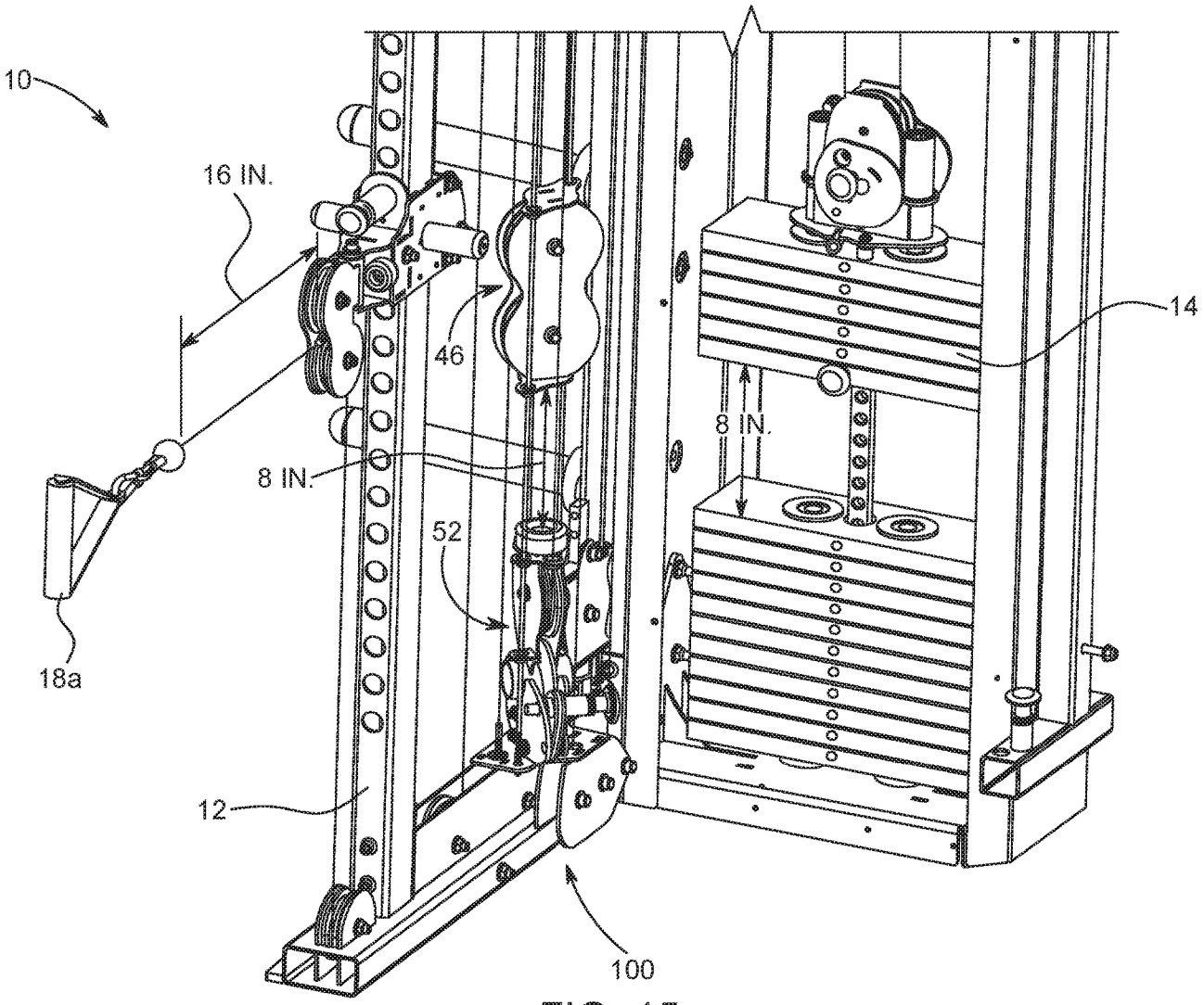
FIG. 15 is a perspective view of the weight ratio arrangement of FIG. 5 in a 2:1 weight ratio configuration.
Figure 16:
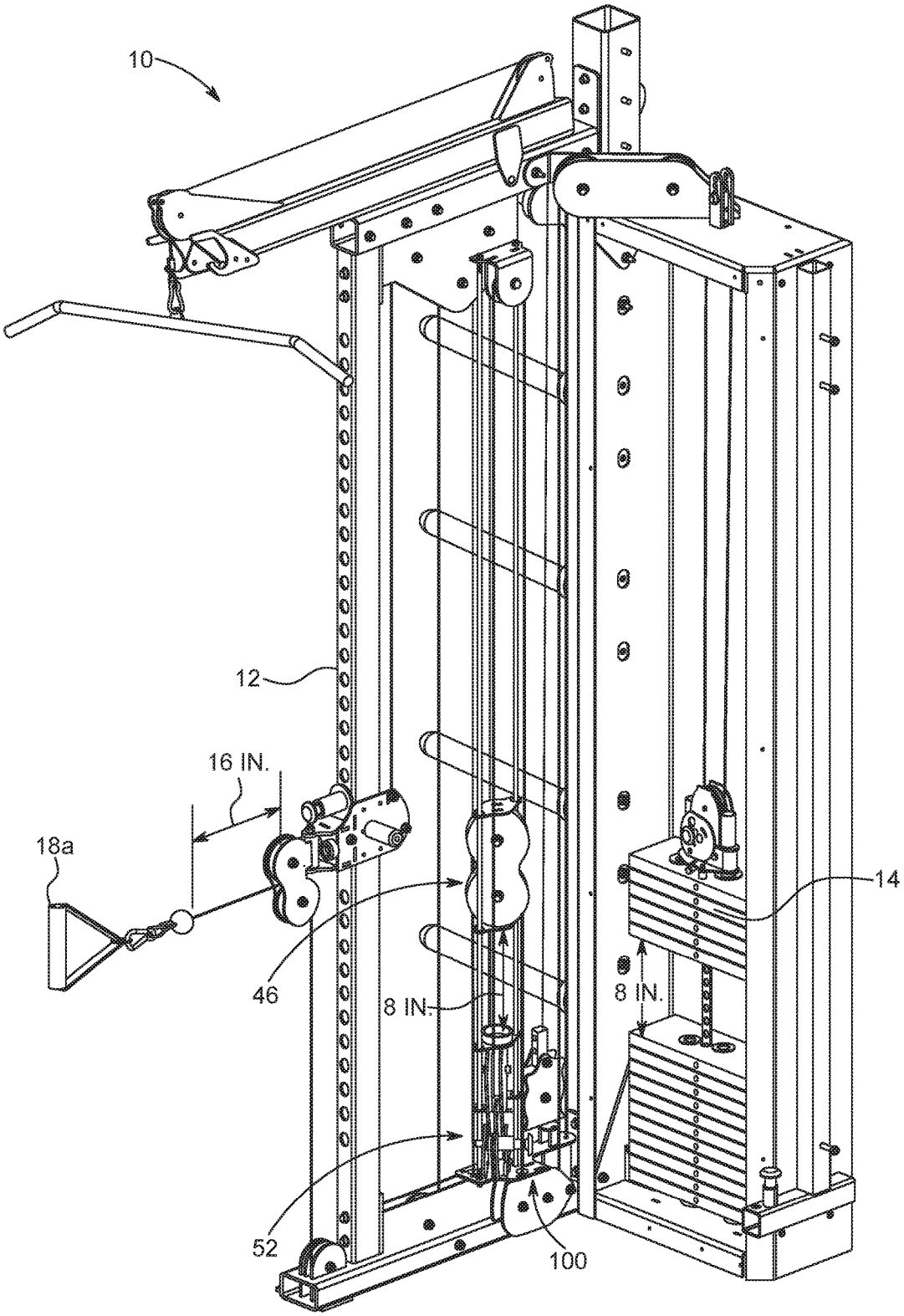
FIG. 16 is another perspective view of the weight ratio arrangement of FIG. 5 in a 2:1 weight ratio configuration.

With reference to FIGS. 15-20, operation of the exercise machine 10 using the weight ratio arrangement 30 is described. As shown in FIGS. 15 and 16, with the locking mechanism 100 in a locked position, the exercise machine 10 is set in a 2:1 weight ratio arrangement for the exercise handle 18*a*. In this 2:1 weight ratio arrangement, the top movable pulley block 46 and weight stack 14 move half the distance that the user pulls the handle 18*a* from the support frame 12. For example, if the user were to pull the handle 18*a* sixteen (16) inches from the support frame 12, the top movable pulley block 46 and the weight stack 14 would only be moved vertically eight (8) inches. With reference to FIG. 21*a*, as the user pulls the handle 18*a* from the support frame 12, the exercise cable 32 pulls on the pulley 48 of the top movable pulley block 46. In turn, the top movable pulley block 46 is pulled vertically upward by the exercise cable 32. Since the locking mechanism 100 is positioned in the locked position, the bottom movable pulley block 52 remains stationary on the support frame 12. Further, with the movement of the top movable pulley block 46 in the upward direction, the bottom pulley 84 housed in the top movable pulley block 46 pulls the weight stack cable 72 upwards. With the vertical movement of the weight stack cable 72, the pulley 78 on the weight stack 14 is pulled in a vertical direction to provide resistance to the user performing the exercises. In the configuration shown in FIG. 24, the weight stack cable 32 would directly pull the weight stack 14.

Figure 17:
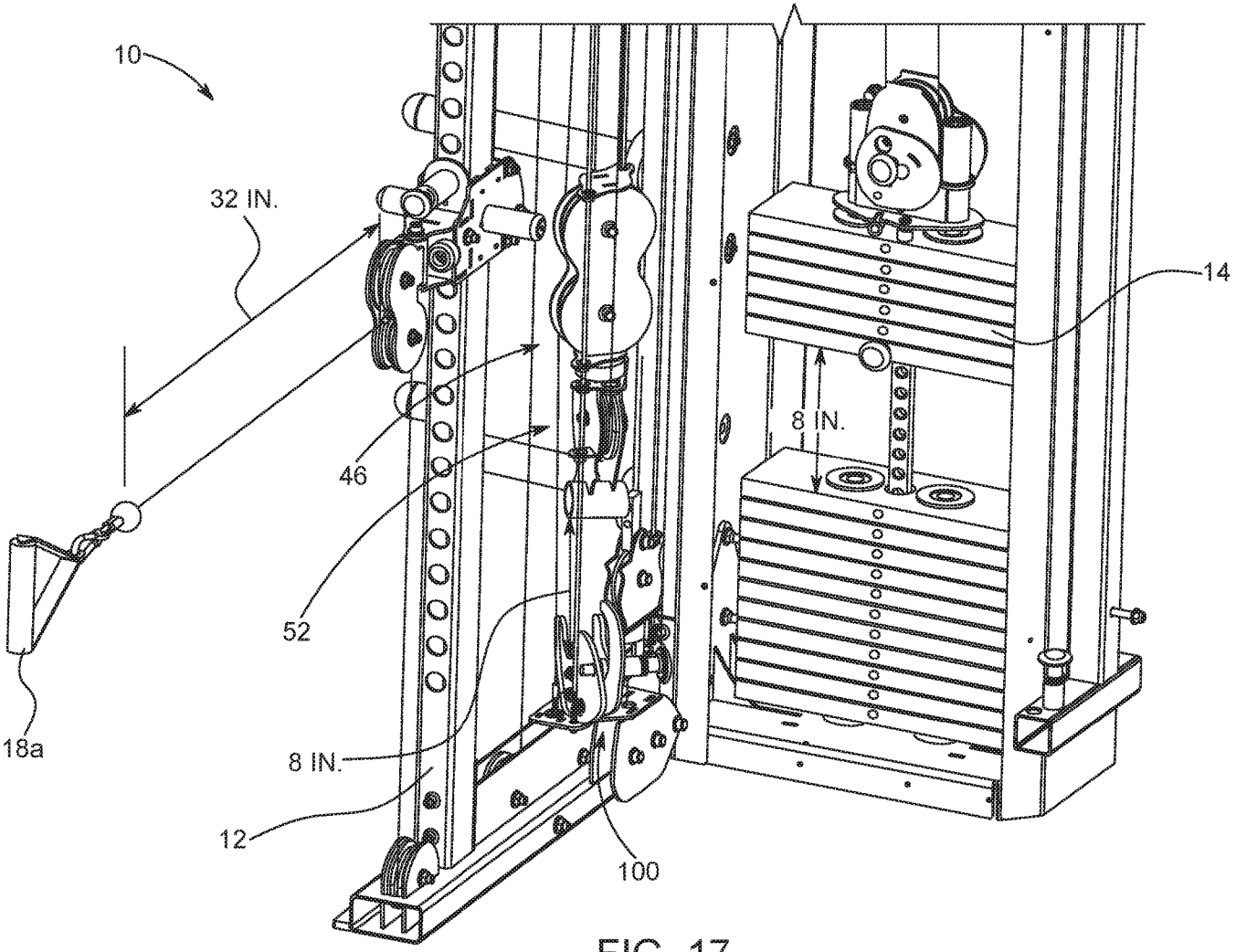
FIG. 17 is a perspective view of the weight ratio arrangement of FIG. 5 in a 4:1 weight ratio configuration.
Figure 18:
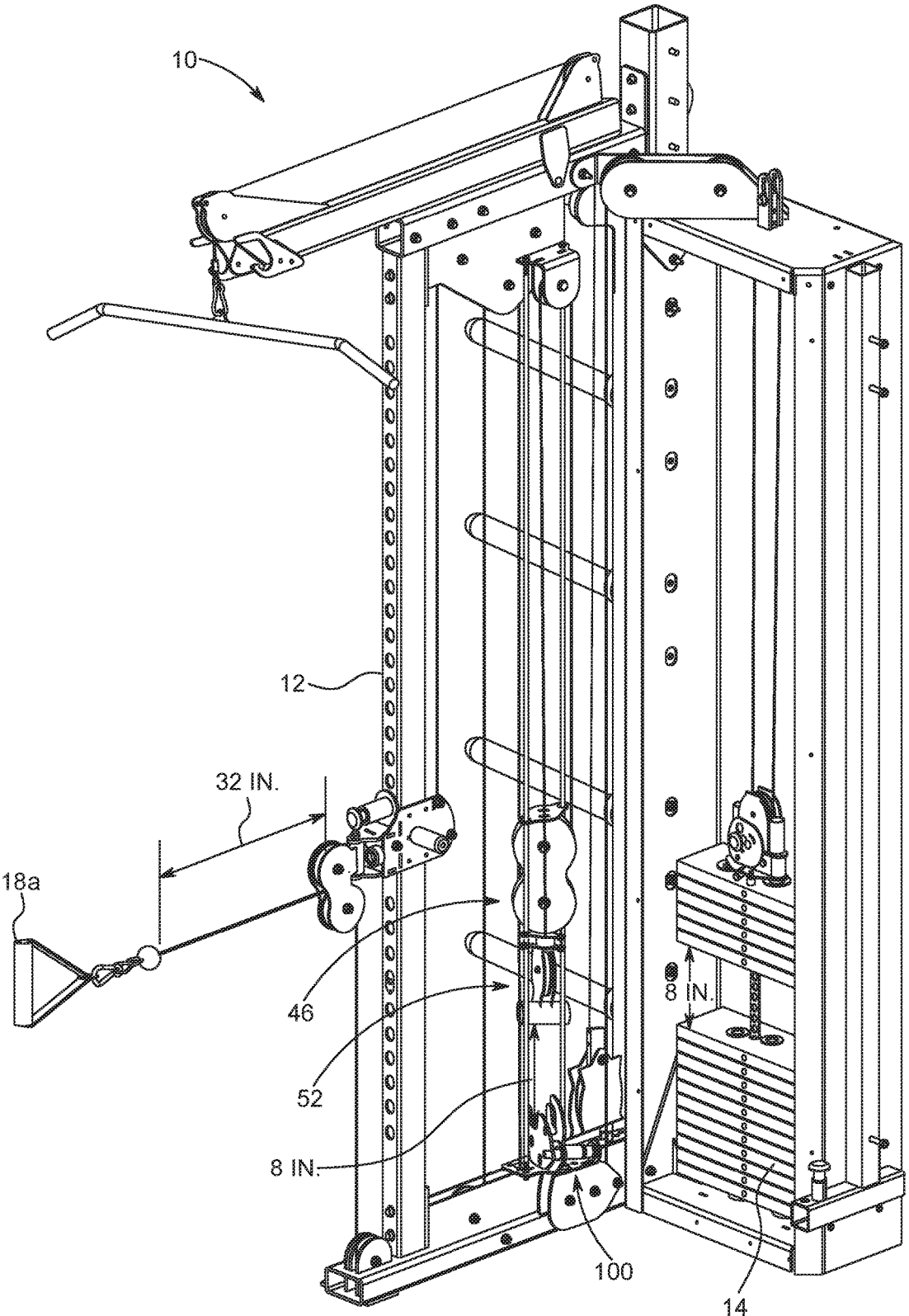
FIG. 18 is another perspective view of the weight ratio arrangement of FIG. 5 in a 4:1 weight ratio configuration.
Figure 21B:
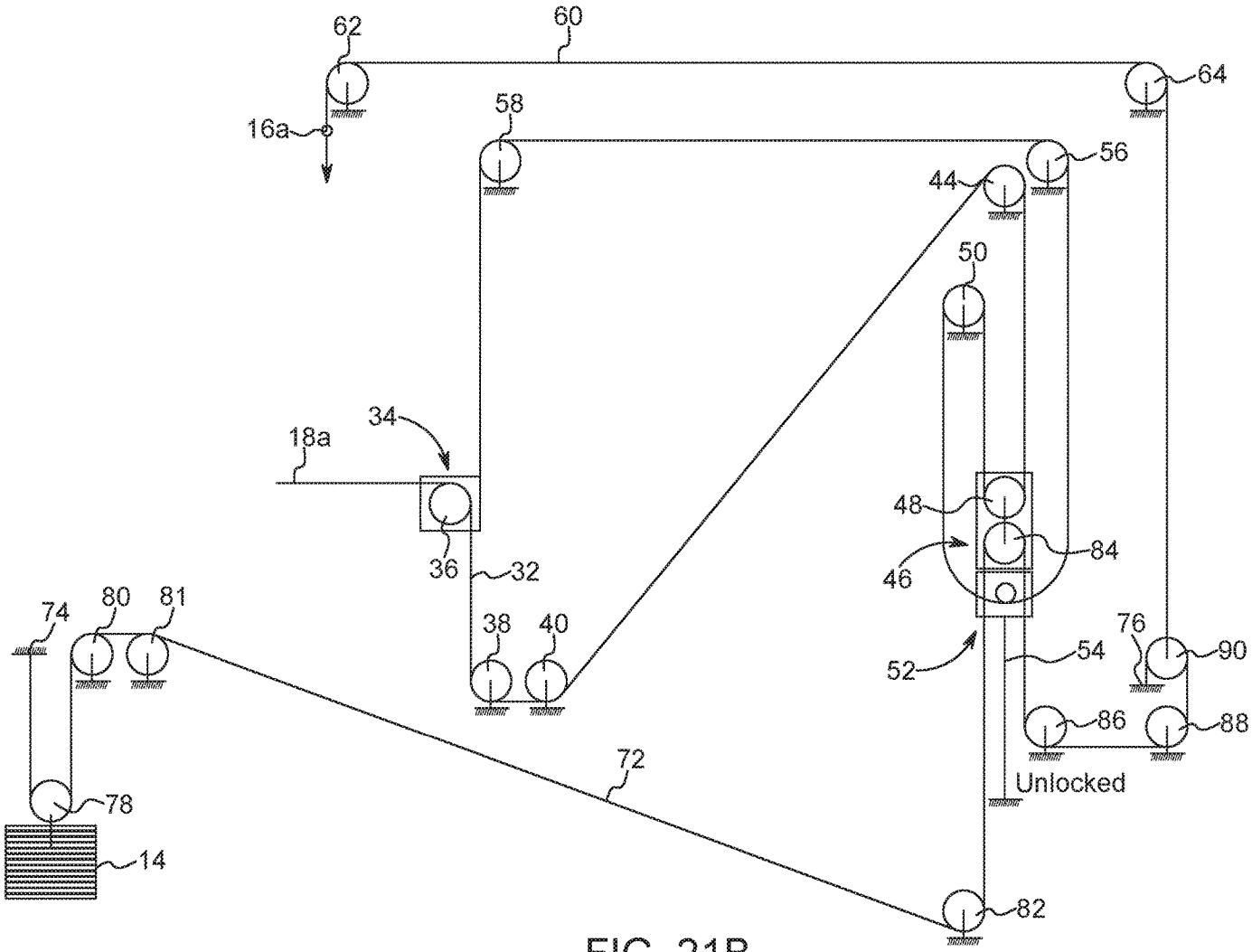
FIG. 21*b* is a schematic illustration of the weight ratio arrangement and weight stack pulley arrangement of FIG. 5 in a 4:1 weight ratio setting.

As shown in FIGS. 17 and 18, with the locking mechanism 100 in an unlocked position, the exercise machine 10 is set in a 4:1 weight ratio arrangement for the exercise handle 18*a*. In this 4:1 weight ratio arrangement, the top movable pulley block 46, the bottom movable pulley block 52, and the weight stack 14 move a quarter the distance that the user pulls the handle 18*a* from the support frame 12. For example, if the user were to pull the handle 18*a* 32 inches from the support frame 12, the top movable pulley block 46, the bottom movable pulley block 52, and the weight stack 14 would only be moved vertically eight (8) inches. With reference to FIG. 21*b*, as the user pulls the handle 18*a* from the support frame 12, the exercise cable 32 pulls on the pulley 48 of the top movable pulley block 46. In turn, the top movable pulley block 46 is pulled vertically upward by the exercise cable 32. Since the locking mechanism 100 is positioned in the unlocked position, the exercise cable 32 will also pull the bottom movable pulley block 52 in a vertical direction. Further, with the movement of the top movable pulley block 46 in the upward direction, the bottom pulley 84 housed in the top movable pulley block 46 pulls the weight stack cable 72 upwards. With the vertical movement of the weight stack cable 72, the pulley 78 on the weight stack 14 is pulled in a vertical direction to provide resistance to the user performing the exercises. In the configuration shown in FIG. 24, the weight stack cable 32 would directly pull the weight stack 14.

Figure 19:
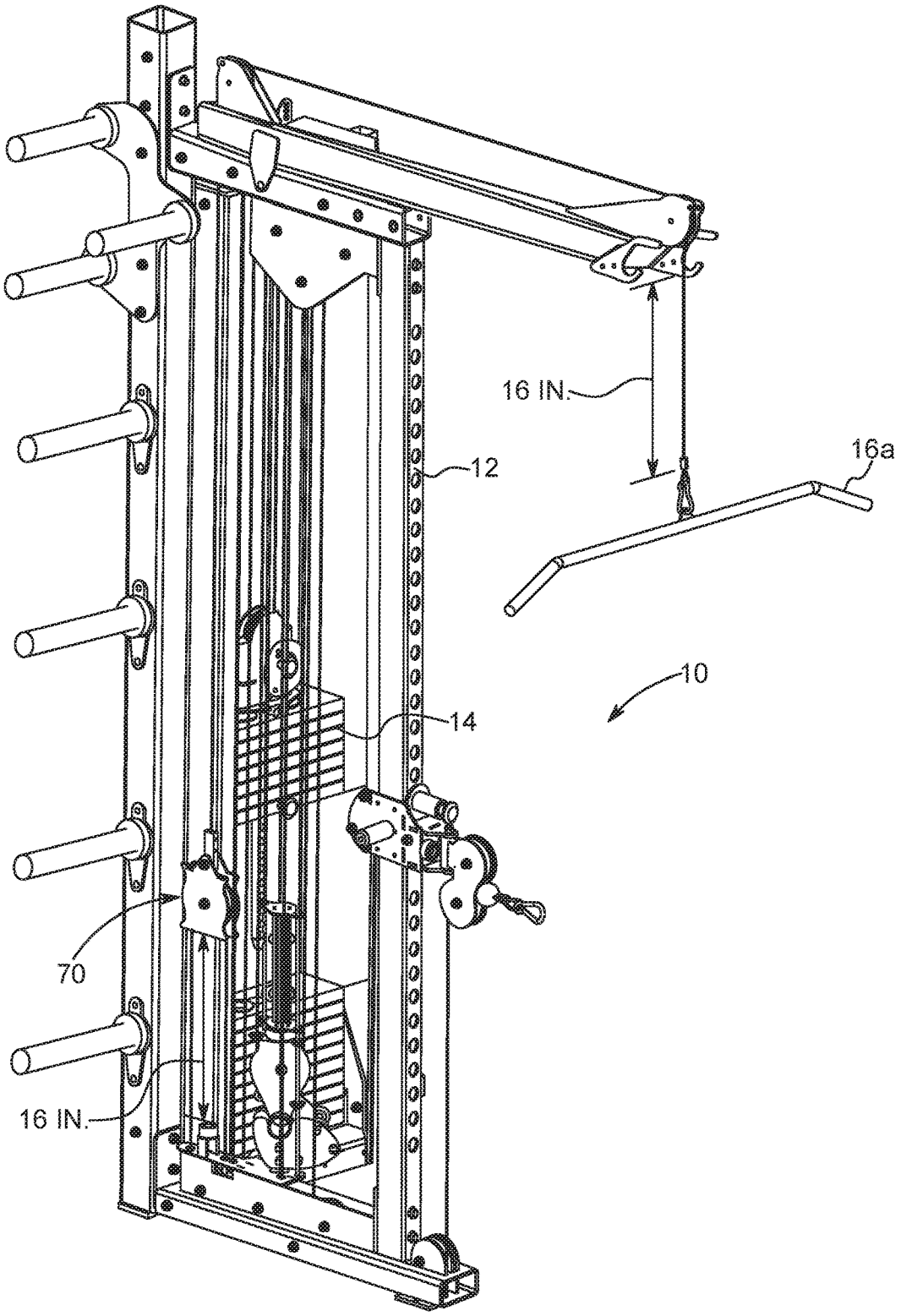
FIG. 19 is a perspective the weight ratio arrangement of FIG. 5 in a 1:1 weight ratio configuration for use with the lat bar.
Figure 20:
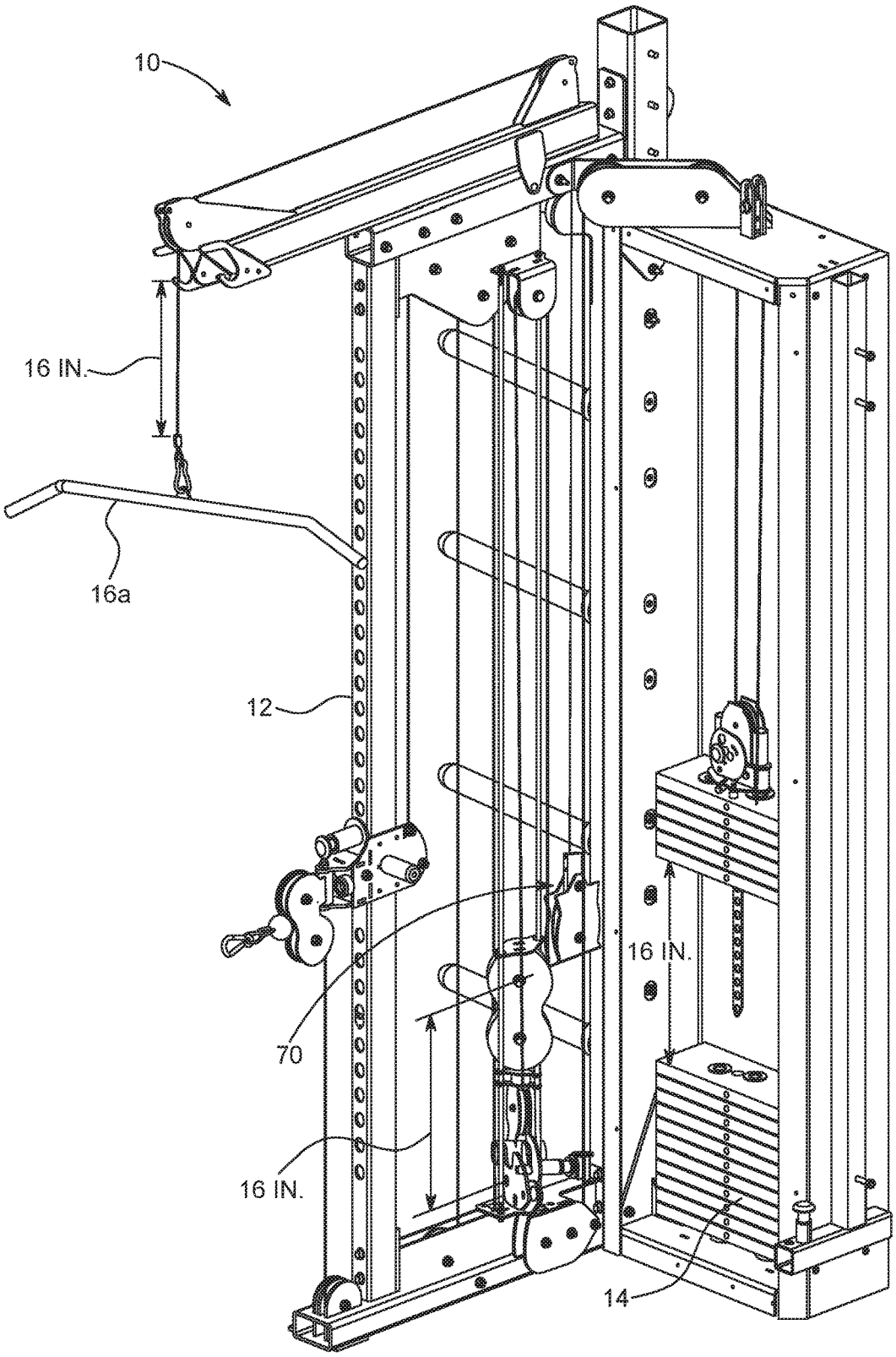
FIG. 20 is another perspective view of the weight ratio arrangement of FIG. 5 in a 1:1 weight ratio configuration for use with the lat bar.

As shown in FIGS. 19 and 20, a weight ratio arrangement of 1:1 is provided for the lat bar 16*a*. In this 1:1 weight ratio arrangement, the pulley block 70 and the weight stack 14 move the same distance that the user pulls the lat bar 16*a* from the support frame 12. For example, if the user were to pull the lat bar 16*a* sixteen (16) inches from the support frame 12, the pulley block 70 and the weight stack 14 would be moved vertically sixteen (16) inches. With reference to FIG. 21*a*, as the lat bar 16*a* is pulled from the support frame 12 by the user, the lat bar cable 60 pulls the pulley 90 upwards. As the pulley 90 is pulled upwards, the weight stack cable 72 is also pulled upwards. With the vertical movement of the weight stack cable 72, the weight stack cable 72 pulls the pulley 78 or the weight stack 14 directly (shown in FIG. 24) to provide resistance to the user pulling on the lat bar 16*a*.

While various aspects of the exercise machine 10 were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. An exercise machine, comprising:

a support frame;

a weight stack slidably connected to the support frame;

a weight ratio pulley arrangement engaged with the support frame, the weight stack, and an attachment extending from the support frame, the weight ratio arrangement comprising:

an exercise cable having a first end and a second end, the first end being connected to the attachment and the second end being connected to a portion of the support frame; and at least two movable pulley blocks, each movable pulley block including at least one pulley, a weight stack pulley arrangement engaged with the support frame, the weight stack, and one of the movable pulley blocks of the weight ratio pulley arrangement, the weight stack pulley arrangement comprising a weight stack cable having a first and a second end, the first end connected to the weight stack and the second end connected to the support frame, wherein the weight stack cable is in operative connection with one of the movable pulley blocks of the weight ratio pulley arrangement; and a locking mechanism movable between a locked position in which only one movable pulley block is movable and an unlocked position in which the two movable pulley blocks are movable.

2. The exercise machine as claimed in claim 1, wherein a first movable pulley block of the at least two movable pulley blocks is operatively connected to the exercise cable and the weight stack cable, wherein a second movable pulley block of the at least two movable pulley blocks is operatively connected to only the exercise cable, and wherein the second movable pulley block is prevented from moving when the locking mechanism is provided in the locked position.

3. The exercise machine as claimed in claim 1, wherein a first movable pulley block of the at least two movable pulley blocks comprises two pulleys, and wherein a second movable pulley block of the at least two movable pulley blocks comprises one pulley.

4. The exercise machine as claimed in claim 1, wherein the locking mechanism comprises:

a latching lever; and a handle insertable into the latching lever to place the latching lever in a locked position.

5. The exercise machine as claimed in claim 4, wherein the latching lever is rotatable between an unlocked position in which the latching lever is disengaged from one movable pulley block of the at least two movable pulley blocks, and a locked position in which the latching lever is engaged with the one movable pulley block of the at least two movable pulley blocks.

6. The exercise machine as claimed in claim 1, further comprising at least one pulley positioned on the support frame adjacent the attachment, wherein the at least one pulley directs the exercise cable in a downward direction.

7. The exercise machine as claimed in claim 6, wherein the at least one pulley is movable in a vertical direction on the support frame.

8. The exercise machine as claimed in claim 1, further comprising at least one guide rod attached to the support frame, wherein the at least two movable pulley blocks are configured to move in a vertical direction along the at least one guide rod.

9. The exercise machine as claimed in claim 1, further comprising a stop member positioned between the at least two movable pulley blocks to prevent the at least two movable pulley blocks from contacting one another.

10. A cable and pulley arrangement for an exercise machine, comprising:

a weight ratio pulley arrangement engaged with the support frame, the weight stack, and an attachment extending from the support frame, the weight ratio arrangement comprising:

an exercise cable having a first end and a second end, the first end being connected to the attachment and the second end being connected to a portion of the support frame; and at least two movable pulley blocks, each movable pulley block including at least one pulley, a weight stack pulley arrangement engaged with the support frame, the weight stack, and one of the movable pulley blocks of the weight ratio pulley arrangement, the weight stack pulley arrangement comprising a weight stack cable having a first and a second end, the first end connected to the weight stack and the second end connected to the support frame, wherein the weight stack cable is in operative connection with one of the movable pulley blocks of the weight ratio pulley arrangement; and a locking mechanism movable between a locked position in which only one movable pulley block is movable and an unlocked position in which the two movable pulley blocks are movable.

11. The cable and pulley arrangement for an exercise machine as claimed in claim 10, wherein a first movable pulley block of the at least two movable pulley blocks is operatively connected to the exercise cable and the weight stack cable, wherein a second movable pulley block of the at least two movable pulley blocks is operatively connected to only the exercise cable, and wherein the second movable pulley block is prevented from moving when the lock mechanism is provided in the locked position.

12. The cable and pulley arrangement for an exercise machine as claimed in claim 10, wherein a first movable pulley block of the at least two movable pulley blocks comprises two pulleys, and wherein a second movable pulley block of the at least two movable pulley blocks comprises one pulley.

13. The cable and pulley arrangement for an exercise machine as claimed in claim 10, wherein the locking mechanism comprises:

a latching lever; and a handle insertable into the latching lever to place the latching lever in a locked position.

14. The cable and pulley arrangement for an exercise machine as claimed in claim 13, wherein the latching lever is rotatable between an unlocked position in which the latching lever is disengaged from one movable pulley block of the at least two movable pulley blocks, and a locked position in which the latching lever is engaged with the one movable pulley block of the at least two movable pulley blocks.

15. The cable and pulley arrangement for an exercise machine as claimed in claim 10, further comprising at least one guide rod attached to a support frame, wherein the at least two movable pulley blocks are configured to move in a vertical direction along the at least one guide rod.

16. The cable and pulley arrangement for an exercise machine as claimed in claim 10, further comprising a stop member positioned between the at least two movable pulley blocks to prevent the at least two movable pulley blocks from contacting one another.

17. A method of operating an exercise machine, comprising:

(a) setting a locking mechanism on a support frame of the exercise machine to either an unlocked or locked position;

(b) pulling an exercise cable relative to a support frame of the exercise machine; and (c) with the locking mechanism in the unlocked position, upon pulling the exercise cable, pulling at least two movable pulley blocks that in turn pulls a weight stack operatively connected to one of the movable pulley blocks via a weight stack cable; or (d) with the locking mechanism in the locked position, upon pulling the exercise cable, pulling one movable pulley block that in turn pulls a weight stack operatively connected to the movable pulley block.

18. The method of operating an exercise machine as claimed in claim 17, wherein a first movable pulley block of the at least two movable pulley blocks is operatively connected to the exercise cable and the weight stack cable, wherein a second movable pulley block of the at least two movable pulley blocks is operatively connected to only the exercise cable, and wherein the second movable pulley block is prevented from moving when the locking mechanism is provided in the locked position.

19. The method of operating an exercise machine as claimed in claim 17, wherein the locking mechanism comprises a handle that is configured to be pulled away from the locking mechanism to unlock the locking mechanism.

20. The method of operating an exercise machine as claimed in claim 17, wherein the at least two movable pulley blocks are configured to move along at least one guide rail.

* * * * *